United States Patent [19]

Kawasaki et al.

[11] Patent Number: 4,799,353

[45] Date of Patent: Jan. 24, 1989

[54] METHOD FOR PIECING ROVINGS AND EXCHANGE ROVING BOBBINS IN A RING SPINNING FRAME AND WORKING MACHINE FOR CARRYING OUT THIS METHOD

[75] Inventors: Yoshio Kawasaki; Tatutake Horibe, both of Fujieda; Kenji Sasaki, Komaki; Kazuo Yamada, Inazawa, all of Japan

[73] Assignee: Howa Machinery, Ltd., Aichi, Japan

[21] Appl. No.: 89,604

[22] Filed: Aug. 25, 1987

[30] Foreign Application Priority Data

Aug. 25, 1986 [JP] Japan ..... 61-197316

[51] Int. Cl.[4] ..... D01H 9/18; D01H 9/10; D01H 15/00

[52] U.S. Cl. ..... 57/281; 57/90; 57/261; 57/268; 57/276

[58] Field of Search ..... 57/281, 261, 276, 266, 57/268, 278, 90

[56] References Cited

U.S. PATENT DOCUMENTS 3,773,191 11/1973 Ishida ..... 57/281 X
4,438,622 3/1984 Pons ..... 57/261
4,473,997 10/1984 Kawasaki et al. ..... 57/276
4,583,358 4/1986 Krieger et al. ..... 57/281
4,630,435 12/1986 Igel ..... 57/281

*Primary Examiner*—John Petrakes
*Attorney, Agent, or Firm*—Michael N. Meller

[57] ABSTRACT

A method and apparatus for piecing rovings introduced from almost exhausted roving bobbins suspended by two rows of bobbin hangers mounted on a creel of a conventional ring spinning frame provided with a roving bobbin supply rail disposed in front of the creel, with rovings introduced from full packaged roving bobbins previously carried to the respective supply positions of the supply rail, said for exchanging the almost exhausted roving bobbins for the full packaged roving bobbins. A piecing rovings operation is carried out for each pair of almost exhausted roving bobbins suspended by a front row bobbin hanger and a back row bobbin hanger of the creel, facing each other, together with two corresponding adjacent full packaged roving bobbins of the supply rail, respectively. A roving bobbin exchanging operation is carried out for each pair of almost exhausted roving bobbins having completed the roving piecing operation for corresponding full packaged roving bobbins of the supply rail having completed the roving piecing operation. The roving bobbin exchanging operation and the roving piecing operation are performed in parallel and at the same time.

11 Claims, 18 Drawing Sheets

METHOD FOR PIECING ROVINGS AND EXCHANGE ROVING BOBBINS IN A RING SPINNING FRAME AND WORKING MACHINE FOR CARRYING OUT THIS METHOD

BACKGROUND OF THE INVENTION

Description of the Related Arts

It is well known in the art that the roving of roving bobbins suspended by bobbin hangers on a creel of a ring spinning frame is provided with a low twist, and thus the tensile strength of such a roving is very weak, and therefore, the roving is easily broken under a low tension. Accordingly, the operation of piecing rovings at the time of a roving bobbin exchange operation have been manually carried out. To apply an automatic operation system to this roving bobbin piecing operation, the method of exchanging roving bobbins in the spinning machine and the apparatus for carrying out this method were developed by the present inventors, and these new developments were disclosed in Japanese Unexamined Patent Publication Nos. 62 (1987)-53426 and 62 (1987)-53425, respectively. In these new developments, a plurality of almost exhausted or exhausted roving bobbins (six roving bobbins in the embodiment) in the front row on the creel are changed for a plurality of full packaged roving bobbins (six full packaged roving bobbins in the embodiment) reserved on a supply rail, and the respective rovings of the exhausted or almost exhausted roving bobbins and the respective rovings of the corresponding full packaged roving bobbins are pieced when exchanging the roving bobbins. The above mentioned roving bobbins in the exhausted or almost exhausted condition are hereinafter referred as the exhausted roving bobbin. However, these inventions have a problem in practical application in that the inventions are applicable only to a spinning frame equipped with a roving bobbin interchanging device, because the full packaged roving bobbins which have replaced the exhausted roving bobbins in the front row of the creel and full packaged roving bobbins in the back row of the creel must be interchanged before the next roving bobbin exchanging operation.

To solve this problem, methods of simultaneously exchanging a pair of front and back exhausted roving bobbins for two adjacent full packaged roving bobbins reserved on a supply rail are proposed, for example, in Japanese Unexamined Patent Publication Nos. 61 (1986)-119728 and 61(1986)-102428. However, the function of either method is limited to merely automating the work for exchanging exhausted roving bobbins for full packaged roving bobbins respectively. Furthermore, according to those methods, four pegs, i.e., two pegs for exhausted roving bobbins and two pegs for full packaged roving bobbins, are moved along separate three-dimensional paths, respectively, when exchanging the roving bobbins, and thus those methods require a large space for carrying out the roving bobbin exchanging operation, and the roving bobbin exchanging device has complicated construction. Accordingly, it is difficult, from the view-point of design, to incorporate mechanisms necessary for piecing rovings into such a roving bobbin exchanging device. Simultaneous execution of a unit roving piecing operation and roving bobbin exchanging operation applied for two roving bobbins, as disclosed in Japanese Unexamined Patent Publication (Kokai) No. 62-6298, of the present inventors, requires a long time, i.e., at least three times the time required for carrying out the roving bobbin exchanging operation/spindle by the invention disclosed in Japanese Unexamined Patent Publication No. 62 (1987)-6298, and therefore, this invention is practically undesirable because of the very long time necessary for exchanging all of the roving bobbins on the creel of such a spinning frame having two hundred and forty spindles or above on one side thereof.

SUMMARY OF THE INVENTION

Accordingly, it is an object of the present invention to provide a method and apparatus for carrying out the roving piecing operation and the roving bobbin exchanging operation separately but simultaneously, such that the above-mentioned roving bobbin exchanging operation is only applied in the combination of the exhausted roving bobbins and the full packaged roving bobbins, which the above-mentioned roving piecing operation has completed, so that the unit operation of the roving piecing operation can be substantially completed within the time required for completing the unit operation of the roving bobbin exchanging operation or vice versa.

This operation is applied to a so-called conventional ring spinning frame provided with a plurality of bobbin hangers aligned in two rows on the creel along the alignment of a spindle and on each side thereof, in positions respectively facing the corresponding draft parts, and a supply rail arranged in front of the creel which is capable of carrying a plurality of bobbin hangers. To simplify the description of the invention, the term "conventional ring spinning frame" is hereinafter referred to as "spinning frame". In other words, a unit roving piecing operation applied to a pair of exhausted roving bobbins suspended by a front roving hanger and a front roving hanger of the creel in facing condition and a unit roving bobbin exchanging operation applied to a pair of exhausted roving bobbins which have completed the above-mentioned roving piecing operation, suspended by another pair of a front roving hanger and a back roving hanger of the creel, facing each other, can be carried out in parallel and at the same time.

The present invention was developed based upon the following basic technical idea, that is, when the roving bobbins suspended by the respective bobbin hangers of the creel mounted on each side of a spinning frame become almost exhausted respectively, the rovings supplied from pairs of exhausted roving bobbins, one of each pair being suspended by a bobbin hanger of a front row, while the other one of each pair is suspended by a bobbin hanger of a back row, facing each other, are pieced with respective end of rovings introduced from the corresponding full packaged roving bobbins suspended by respective two adjacent bobbin hangers of the supply rail at the respective positions upstream of the corresponding draft parts of the spinning frame, respectively, and immediately after the above-mentioned operation, the rovings from the above-mentioned respective exhausted roving bobbins are separated from their supplying condition to the corresponding draft parts, so that a unit roving piecing operation applied between each pair of exhausted roving bobbins and the corresponding pairs of the full packaged roving bobbins mentioned above can be completed, and after transferring the above-mentioned pair of exhausted roving bobbins, completing the unit roving piecing operation to the corresponding bobbin hangers without any roving bobbin, which condition is created by a previous step of carrying out the roving bobbin exchanging operation or by a previous operation for reserving such a bobbin hanger on the supply rail, a pair of full packaged roving bobbins having completed the above-mentioned unit roving piecing operation, which are suspended by two adjacent bobbin hangers of the supply rail, from which rovings are supplied to the corresponding draft parts respectively, are transferred to the corresponding bobbin hangers of the creel, respectively, from which the exhausted roving bobbins were taken off by the above-mentioned roving bobbin transferring operation, so that a unit roving bobbin exchanging operation can be completed, and the above-mentioned unit roving piecing operation and the above-mentioned unit roving bobbin exchanging operation are carried out in parallel and at the same time concern, from one side to the other side of the spindle alignment of the spinning frame. Further, during the above-mentioned parallel operations, but before carrying out each unit roving bobbin exchanging operation, it is essential to carry out a unique operation of introducing each pair of rovings from the corresponding full packaged roving bobbins, which have completed the above-mentioned unit roving piecing operation, into the corresponding roving guides mounted on the spinning frame respectively, such that, when the above-mentioned unit roving bobbin exchanging operation is completed, these rovings from the full packaged roving bobbins suspended by a corresponding front bobbin hanger and corresponding back bobbin hanger facing each other in the creel do not interfere with each other. Therefore, in the present invention, a unique method of simultaneously carrying out the above-mentioned roving introducing operations to each pair of two adjacent roving guides and a device for carrying out this operation in the above-mentioned condition, are applied.

As mentioned above, in the present invention, even though the above-mentioned unit piecing operation of the rovings and the unit roving bobbin exchanging operation are carried out separately, it is a characteristic feature of the present invention that these two unit operations are carried out in parallel and at the same time. Further, in the present invention, the above-mentioned operation of introducing a pair of rovings from the full packaged roving bobbins into the corresponding roving guides, before carrying out the unit roving bobbin exchanging operation to these full packaged roving bobbins, is applied. Therefore, the present invention is preferably applied to a spinning frame provided with a roving guide having an upwardly opening aperture, to introduce a roving thereinto, in each mechanism of the spinning unit.

According to the above-mentioned basic technical idea, in the method for carrying out the roving piecing operation and the roving bobbin exchanging operation, when the roving bobbins suspended by the respective bobbin hangers of the creel mounted on each side of a spinning frame become almost exhausted or exhausted respectively, as a unit operation, rovings are picked up simultaneously from a pair of full packaged roving bobbins suspended by two adjacent bobbin hangers of a supply rail arranged along the creel of the spinning frame and in front of and above the creel, the roving ends, which are taken from the above-mentioned two full packaged roving bobbins, are simultaneously doubled with the corresponding rovings which are introduced from the corresponding pair of exhausted roving bobbins, one of which is suspended by a bobbin hanger of a front row in the creel, while the other is suspended by a bobbin hanger of a back row in the creel, facing each other, at the respective positions upstream of the corresponding draft parts of the spinning frame, so that the above-mentioned roving ends are pieced with the corresponding rovings from the above-mentioned exhausted roving bobbins respectively, while the rovings introduced from the above-mentioned respective exhausted roving bobbins are separated from the supplying condition to the corresponding draft parts by breaking, and after the above-mentioned unit operation of piecing rovings, the exhausted roving bobbins, which have completed the above-mentioned unit operation of piecing rovings, are simultaneously transferred to two adjacent bobbin hangers without suspending roving bobbins from the respective bobbin hangers of the creel, and thereafter, two full packaged roving bobbins, which have completed the above-mentioned unit operation of piecing rovings, are simultaneously transferred to the corresponding bobbin hangers of the creel from which the exhausted roving bobbins were taken off, respectively. As already explained in the above-mentioned simultaneous unit operations, it is important to avoid any possibility of intersection of the rovings from a pair of roving bobbins even during the unit operations. Accordingly, the above-mentioned each pair of simultaneous unit operations are stepwisely but successively applied to each pair of exhausted roving bobbin of the front row and back row, facing each other, in the creel of the spinning frame. It is important to recognize that the above-mentioned simultaneous unit operations of piecing rovings and exchanging roving bobbins can be carried out in parallel and at the same time.

In the working machine to carry out the above-mentioned simultaneous operations of piecing rovings and exchanging roving bobbins, the basic technical idea thereof is similar to that of the above-mentioned method. Therefore, the apparatus for carrying out the above-mentioned operation of piecing roving bobbins (hereinafter referred to as "roving piecing apparatus") and the apparatus for carrying out the above-mentioned operation of exchanging roving bobbins (hereinafter referred to as "roving bobbin exchanging apparatus") can be constructed as separate machines or as integrated machines constructed as one unit machine, wherein they are arranged in order to carry out their simultaneous unit operations. In any type of the working machines mentioned above, it is essential to provide a device for introducing rovings to the corresponding roving guides mounted on the spinning frame, respectively, and this device may be mounted on the roving piecing apparatus or on the roving bobbin exchanging apparatus. According to the present invention, the working machine to carry out the desired operation can be made compact, so that the roving bobbin exchanging operation comprising the above-mentioned roving piecing operation and the roving bobbin exchanging operation, at the time that the roving bobbins suspended by the respective bobbin hangers of the creel become exhausted or almost exhausted, can be mechanically carried out in practice, and accordingly, the present invention can effectively contribute to the automation of a spinning factory.

BRIEF EXPLANATION OF THE DRAWINGS

FIG. 6 is a side view of the roving-end catching device shown in FIG. 5;

DESCRIPTION OF THE PREFERRED EMBODIMENTS

The construction and function of preferred embodiments of the present invention are hereinafter explained in detail with reference to the above-mentioned drawings, respectively.

Figure 1A:
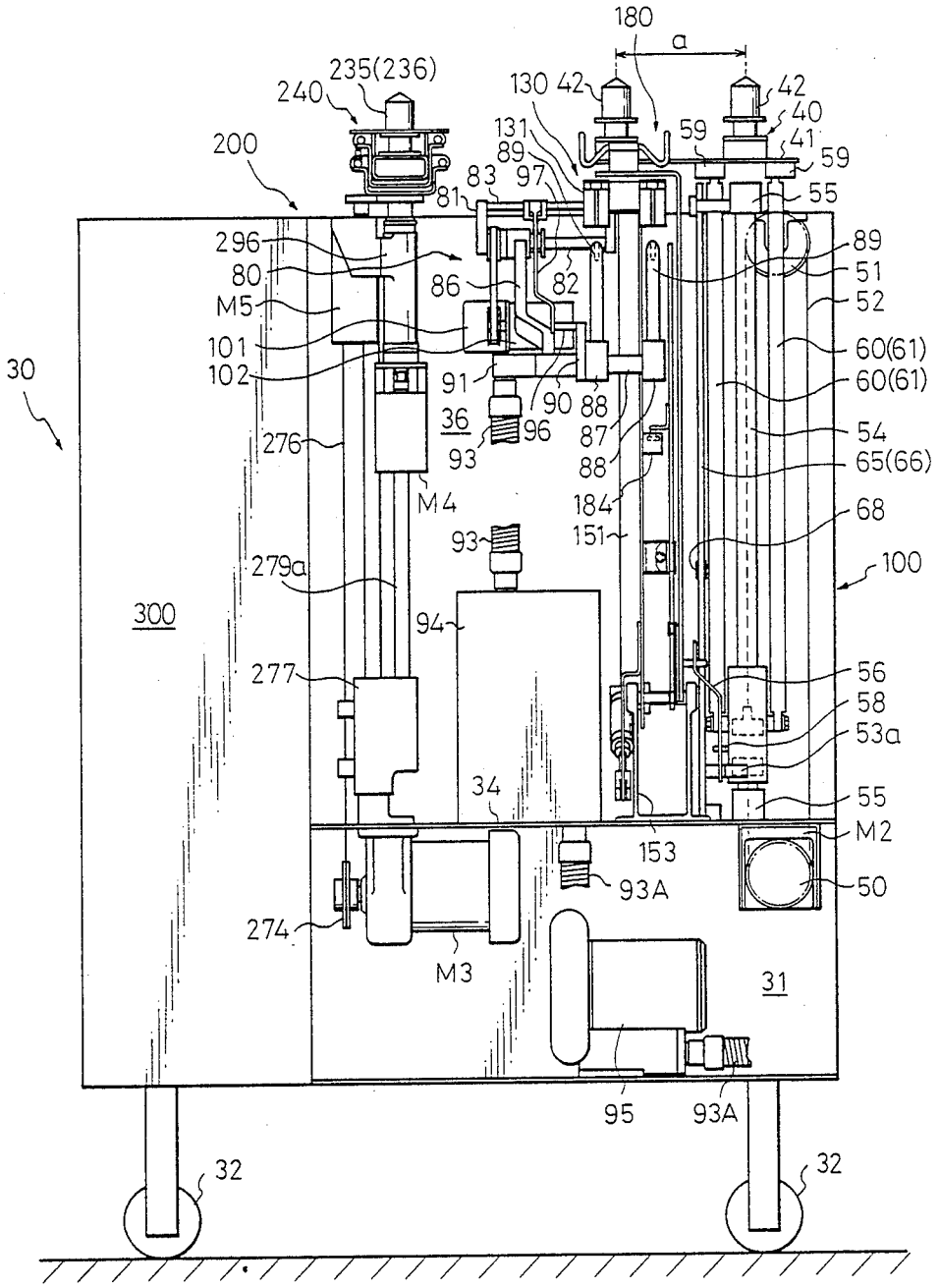
FIG. 1A is a front elevation of one embodiment of the working machine for carrying out the roving-piecing operation and the roving bobbin exchanging operation according to the present invention.
Figure 1B:
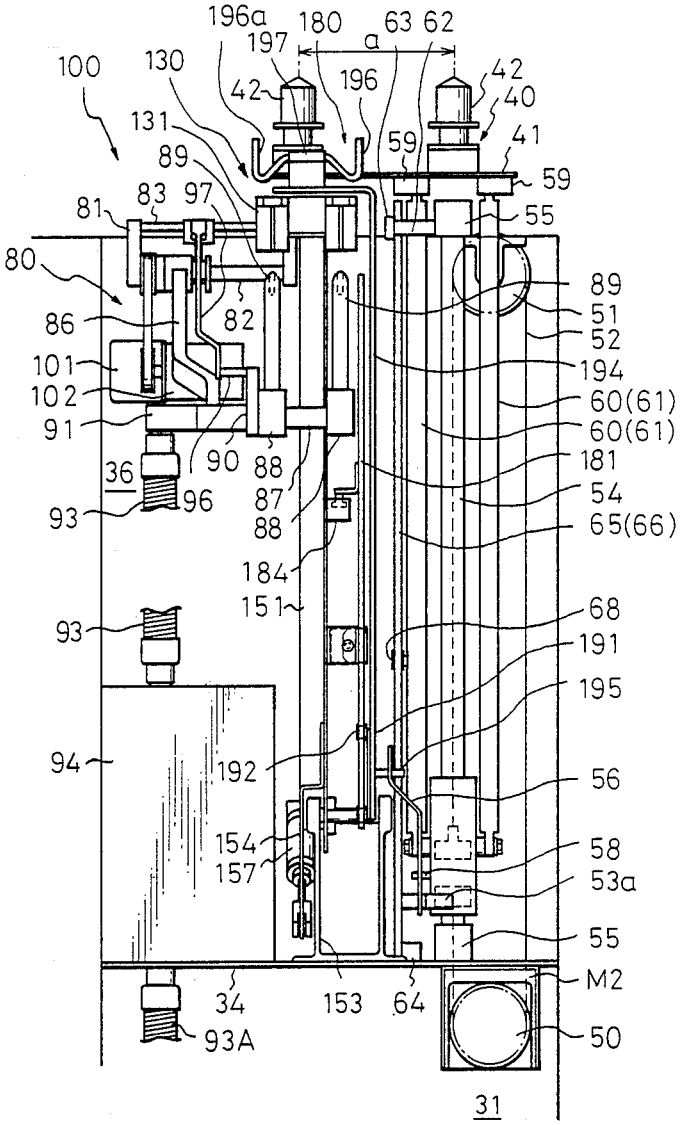
FIG. 1B is a front elevation of a part of the working machine shown in FIG. 1A, which particularly indicates the roving piecing apparatus in more detail.
Figure 2:
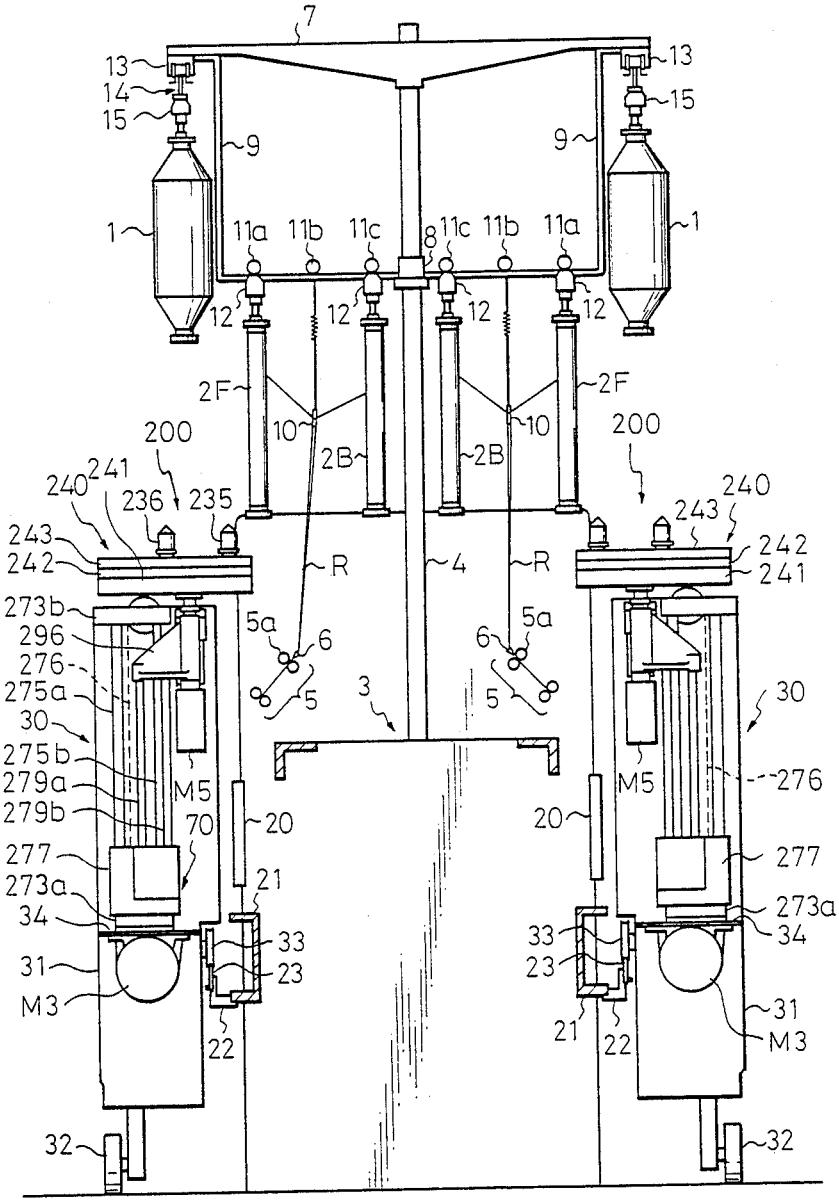
FIG. 2 is a side elevation, partly in section, indicating the relationship between the working machine shown in FIG. 1A and a spinning frame, from the side of the roving piecing apparatus thereof.

Referring to FIGS. 1A, 1B, and 2, indicating a preferable embodiment of a working machine according to the present invention, creel pillars 4 of a creel are mounted upright in the central portion of a machine frame 3 of a spinning frame at appropriate intervals along the longitudinal direction of the frame 3, and a supply rail 13 is disposed at the respective free ends of rail brackets 7, respectively, and secured to respective upper ends of the creel pillars 4 so as to extend along the longitudinal direction of the frame 3. The supply rail 13 is an elongated member having a C-shaped cross section opened in the lower wall thereof. A bobbin carriage 14 is received in the opening of the supply rail 13 so as to be movable therealong. The bobbin carriage 14 carries bobbin hangers 15, the number of the bobbin hangers 15 being a number (n) of the bobbin hangers 12 in the front row of the creel plus two, and the interval between two adjacent bobbin hangers 15 is the same as that between two bobbin hangers 12 on the creel. Full roving packaged bobbins 1 are reserved on the bobbin hangers 15 except for the two additional hangers. The bobbin carriage 14 is located as illustrated by imaginary lines in a plan view in FIG. 2 so that the full packaged roving bobbins 1 carried thereon are located in positions facing the corresponding roving bobbins suspended by the bobbin hangers 12 of the spinning frame, before carrying out the operation according to the present invention. On the other hand, supporting bars 9 are fixed to brackets 8 secured to the creel pillars 4 and to the rail brackets 7, respectively, and three supporting pipes 11*a*, 11*b* and 11*c* are disposed at the supporting bars 9. The bobbin hangers 12 are arranged at predetermined intervals on the supporting pipes 11*a* and 11*c*, and roving guides 10 each formed in the shape of an anchor and having a pair of upwardly projected hooked portions at both sides thereof are arranged on the supporting pipe 11*b*. Roving bobbins 2F and 2B suspended by the respective bobbin hangers 12 are pairs of front and back roving bobbins having the same diameter. Pairs of front and back full packaged roving bobbins and pairs of front and back medium exhausted roving bobbins are arranged alternately on the creel along the longitudinal direction of the spinning frame. When a pair of front and back medium exhausted roving bobbins become exhausted or almost exhausted, the respective rovings from the pair of front and back exhausted or almost exhausted roving bobbins and the respective rovings from the corresponding pair of full packaged roving bobbins are pieced simultaneously.

The roving piecing method in accordance with the present invention is carried out by a working machine 30 which travels along the front side of the frame of a spinning frame. As shown in FIGS. 1A, 1B and 2, wheels 32 and a guide roller 33 are disposed in the lower part and on the side wall facing the spinning frame, respectively, of a main body unit 31 of the working machine 30. When a motor (not shown) mounted in the main body 31 in a known manner for driving the roving piecing unit 31 for travel is actuated, the guide roller 33 rolls along a guide rail 23 secured through brackets 23 to the spindle rail of the spinning frame, whereby the main body 31 of the working machine 30 is moved to and stopped at the respective positions for carrying out the operation by the working machine 30.

The constitution of the working machine 30 will be described hereinafter, and, the construction of the working machine 30 according to the present invention is hereinafter explained in detail with reference to the attached drawings. As shown in FIGS. 1A and 1B, the working machine 30 of the present invention is provided with an apparatus 100 for piecing roving ends which catches a free end of the roving in two adjacent full packaged roving bobbins and carries out the piecing operation of the above-mentioned two free ends of the rovings from the respective full packaged roving bobbins mentioned above with the corresponding rovings from a pair of exhausted roving bobbins suspended by a corresponding pair of a front bobbin hanger and a back bobbin hanger of the creel, which are facing each other, respectively, and an apparatus 200 for exchanging each pair of the above-mentioned exhausted roving bobbins suspended by a corresponding front bobbin hanger and a corresponding back bobbin hanger, which are facing each other, by the corresponding pair of full packaged roving bobbins suspended by two adjacent bobbin hangers, after completion of the above-mentioned roving piecing operation for the above-mentioned exhausted roving bobbin and the full packaged roving bobbins. A device for simultaneously introducing a pair of rovings from the above-mentioned pairs of full packaged roving bobbins wherein the above-mentioned roving piecing operation was completed, and the rovings from the corresponding full packaged roving bobbins are supplied to the corresponding draft parts, respectively, before applying the above-mentioned roving bobbin exchanging operation, is mounted on either one of the above-mentioned two apparatuses 100, 200 or mounted on the combined working machine formed by the above-mentioned two apparatuses 100 and 200. The working machine 30 comprises the above-mentioned two apparatuses together with the roving introducing device. The above-mentioned working machine 30 is hereinafter explained in detail with reference to the attached drawing.

The roving piecing apparatus 100 is constructed by a supporting head 40 for supporting a pair of full packaged roving bobbins 1 in a condition rotatable toward the unwinding direction, a device 80 for catching roving ends and unwinding in the above-mentioned unwinding direction respectively after catching each roving end of the above-mentioned pair of full packaged roving bobbins, and a head 130 for carrying out the above-mentioned roving piecing operation of the roving ends from the full packaged roving bobbins with the corresponding rovings unwound from the pair of exhausted roving bobbins 2F, 2B suspended by the corresponding pair of the front bobbin hanger 12 and the back bobbin hanger 12 of the creel, respectively. To enable a better understanding of the present invention, the construction and function of the supporting head 40 for supporting a pair of full packaged roving bobbins is first explained in detail with reference to FIGS. 1A, 1B, 3 and 4.

Figure 3:
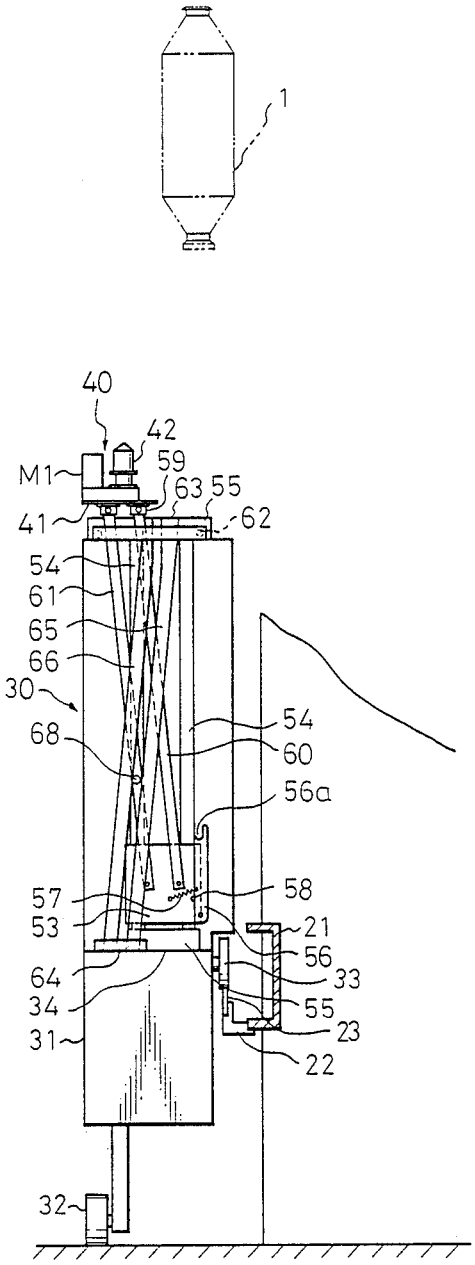
FIG. 3 is a side view, partly in section, showing an essential mechanism of a supporting head for supporting a full packaged bobbin, of the roving piecing apparatus shown in FIGS. 1A and 1B.
Figure 4:
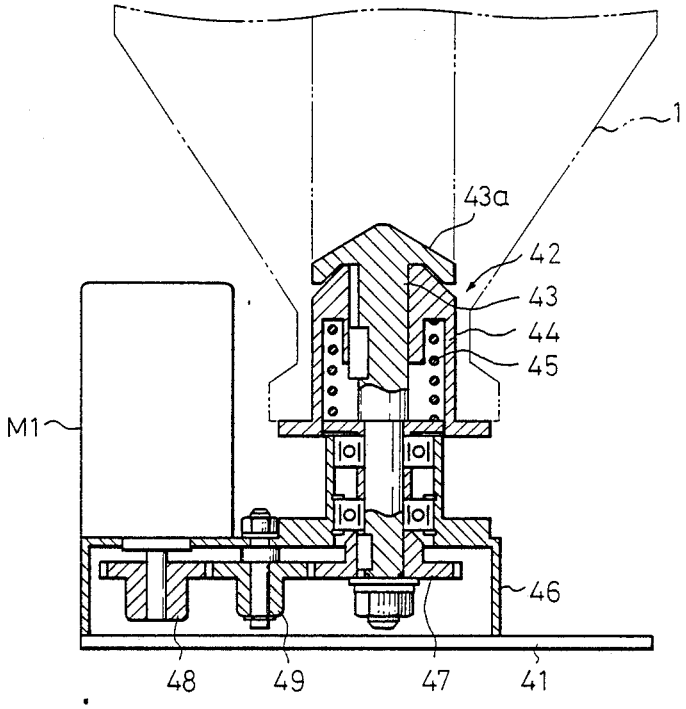
FIG. 4 is a sectional view of the peg which is rotatably mounted on the supporting head shown in FIG. 3.

Two pegs 42 are mounted rotatably on a peg base plate 41 at an interval a corresponding to the interval between the full packaged roving bobbins suspended from the supply rail 13. As shown in FIG. 4, each peg 42 comprises a peg axis 43 and a peg barrel 44 mounted on the peg axis 43 only and capable of sliding in the axial direction vertically in the relation to the peg axis 43. The peg barrel 44 is spline-engaged with the peg axis 43, and is pressed against the head 43*a* of the peg axis 43 by a spring 45. The peg axis 43 is journaled on a box body 46 secured to the peg base plate 41. A gear 48 secured to the output shaft of a peg driving motor M1 engages a gear 47 secured to the lower end of the peg axis 43 through an idle gear 49 to rotate the peg 42. Since the peg barrel 44 can be displaced downward against the resilience of the spring 45, the peg 42 can be engaged with or disengaged from the full packaged roving bobbin 1 without fail, regardless of variations in the height of the full packaged roving bobbins suspended by the respective bobbin hangers 15 of the supply rail 13. A chain 52 is extended between a sprocket 50 secured to the output shaft of a peg lifting motor M2 rigidly mounted on the lower side of the base plate 34 of the roving piecing unit 31 and a sprocket 51 rotatably disposed above the roving piecing unit 31. The chain 52 has one end connected to the upper part of a slide member 53 and the other end connected to the lower part of the slide member 53. Supporting blocks 55 are secured to the top plate and base plate 34 of the roving piecing unit 31, respectively. The slide member 53 is mounted slidably on two guide rods 54 vertically extended between the supporting blocks 55. An arm member 56 for transmitting a vertical motion to a roving introducing bar 194, which will be described hereinafter, is supported pivotally on the boss 53*a* of the slide member 53. The arm member 56 is held upright against a pin 58 secured to the slide member 53 by an extension spring 57 as shown in FIG. 3. The upper end of the arm member 56 is cut to form an engaging part 56*a*. The peg base plate 41 is supported by a parallel link mechanism formed by pivotally joining front links 60 and back links 61 with pins to four blocks 59 secured to the right and left sides of the lower side of the peg base plate 41 and to the slide member 53 respectively. A cam holding plate 63 (FIGS. 1B and 3) is secured to the supporting block 55, which is secured to the top plate by two studs 62, and a cam holding plate 64 is disposed at the base plate 34 of the roving piecing unit 31. Cam plates 65 and 66 are disposed in parallel to each other at the holding plate 63 and 64 to form a cam groove 67. As shown in FIG. 3, the cam groove 67 extends obliquely and the upper portion thereof extends vertically. A cam roller 68, which rolls along the cam groove 67, is mounted pivotally on one of the back links 61. When the peg lifting motor M2 is actuated, the slide member 53 is lifted vertically, the cam roller 68 rises along the cam groove 67 as the slide member 53 is lifted up, the pegs 42 are raised from standby positions (FIG. 3) to positions directly below the corresponding full packaged roving bobbins 1, respectively, and the pegs 42 are inserted into the corresponding full packaged roving bobbins 1 to remove them from the respective bobbin hangers 15. Then, the peg lifting motor M2 is reversed to return the pegs 42 holding the full packaged roving bobbins 1 to the respective standby positions (FIG. 3).

Figure 5:
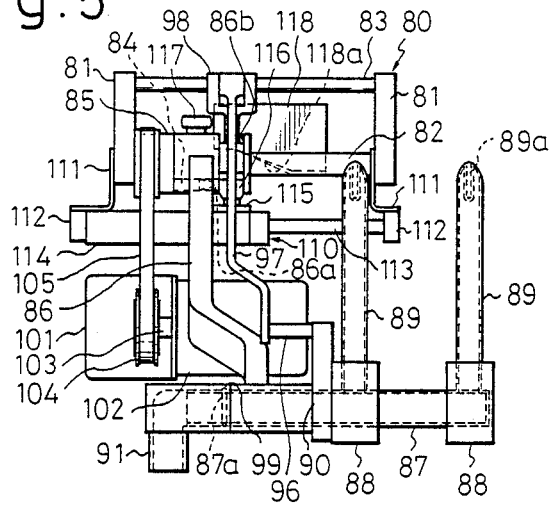
Figure 6:
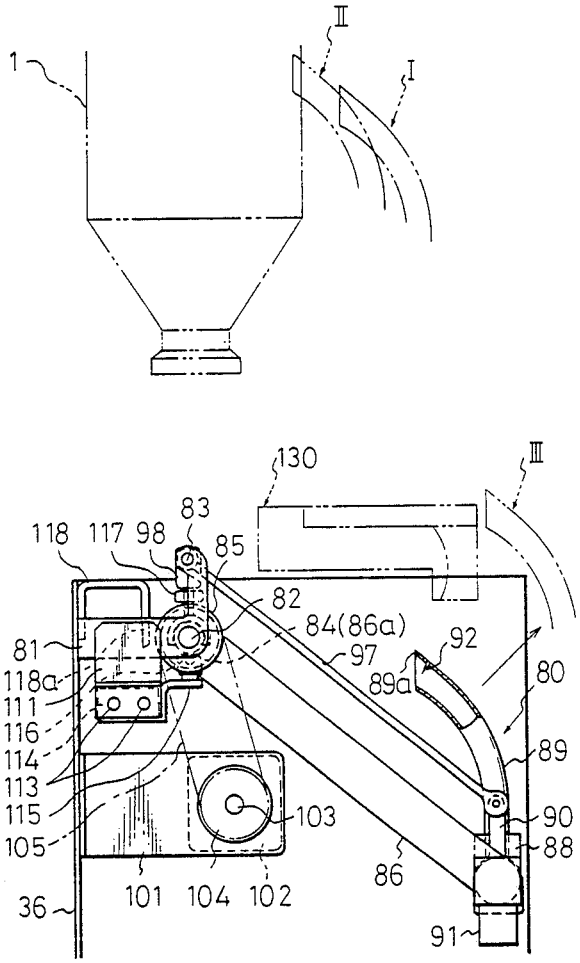
FIG. 6 is a front view of a roving-end catching device of the roving piecing apparatus of the working machine shown in FIGS. 1A and 1B.

The roving end catching device 80 will be described hereinafter with reference to FIGS. 1, 5 and 6. A pair of L-shaped bases 81 are rigidly and symmetrically mounted on the right and left sides, respectively, of a side plate 36 of the roving piecing unit 31. A main slide shaft 82 and an auxiliary slide shaft 83 are supported by the right and left bases 81. A timing belt pulley 85 provided with an engaging pin 84 on the end face thereof and a main arm 86 is mounted loosely on one end of the main slide shaft 82. The engaging pin 84 engages a pin-aperture **86*a* formed in the main arm 86, so that the main arm 86 rotates together with the timing pulley 85. A pipe 87 is rotatably supported on the other end of the main arm 86. A pipe is rotatably disposed at the other end of the main arm 86 and two roving end catching members 89 and a link arm 90 are disposed at the pipe 87 by connecting members 88. An L-shaped pipe joint 91 is mounted loosely on the extremity (the left end as viewed in FIG. 5) of the pipe 87. A pin 99 secured to the pipe joint 91 engages an annular groove formed in the outer circumference of the pipe 87 to prevent a possible escape of the pipe joint 91 from the pipe 87. In this embodiment, the roving end catching members 89 are suction pipes each having needle 92, respectively, which are planted in the form of a comb (FIG. 6). As shown in FIGS. 1A and lB, the pipe joint 91 is connected to a filter box 94 by a hose 93, and the filter box 94 in turn is connected to a blower 95 by a hose 93A. An auxiliary arm 97 is supported rotatably at one end thereof on an interlocking pin 96 projecting from the link 90 of the roving end catching member 89, and is mounted rotatably at the other end thereof on the slide shaft 83. A connecting arm 98 is mounted loosely on the auxiliary slide shaft 83 so as to hold the auxiliary arm 97 in the ends of both sides thereof. The U-shaped lower end of the connecting arm 98 is received in a guide groove 86*b* of the main arm 86. A rotary actuator 102 is disposed at a bracket 101 secured to the side plate 36 of the roving piecing unit 31. A timing belt 105 is extended between a toothed wheel 104 secured to a shaft 103 of the rotary actuator 102 and the timing belt pulley 85. When the rotary actuator 102 operates, the main arm 86 engages with the toothed pulley 85 by the engaging pin 84 and is turned on the main slide shaft 82 approximately through an angle of 90° in a counter clockwise direction, as viewed in FIG. 6, (the auxiliary arm 97 is turned on the auxiliary slide shaft 83, accordingly) to displace the roving end catching member 89 from the standby position, indicated by continuous lines, to the upper position, indicated by imaginary lines I in FIG. 6**, with a parallel motion.

Supporting members 112 (FIG. 5) are disposed through L-shaped holding members 111 to the right and left base 81. The opposite ends of two piston rods 113 of a double-rod cylinder 110 are secured to the supporting members 112, respectively. The double-rod cylinder 110 has a rectangular cylinder body 114, and the two piston rods 113 extending in parallel to the main slide shaft 82. Air is supplied to the right and left pressure chambers of the double-rod cylinder 110 alternately to move the cylinder body 114 in parallel to the main slide shaft 82. A guide roller 116 is supported pivotally on an arm 115 disposed at the cylinder body 114 and is received in the guide groove **86*b* of the main arm 86. A cam follower 117 is supported pivotally on the main arm 86. When the roving end catching member 89 is turned upward approximately through an angle of 90°, the circumference of the cam follower 117 is brought opposite to the cam surface of a plate cam 118 secured to the side plate 36 of the roving piecing unit 31. Accordnngly, when the double-rod cylinder 110 is actuated to advance the cylinder body 114 after the roving end catching member 89 has been turned upward to a position indicated by imaginary lines I in FIG. 6, the cam follower 117 is brought into contact with a cam surface 118*a* of the plate cam 118 immediately before the actuating pin 84 of the timing pulley 85 is disengaged from the aperture 86*a* of the main arm 86. As the cylinder body 114 is advanced further, the actuating pin 84 is disengaged from the aperture 86*a* of the main arm 86 and the cam follower 117 moves along the cam surface 118*a* of the plate cam 118 to turn the main arm 86 in a counterclockwise direction, as viewed in FIG. 5. Upon the arrival of the cylinder body 114 at the terminal position of the forward motion thereof, the respective nozzles 89*a* of the roving end catching members 89 are located in close proximity to the respective outer surface of the full packaged roving bobbins 1 mounted on the respective pegs 42 of the full bobbin supporting head 40 (position indicated by imaginary lines II in FIG. 6**).

Figure 7A:
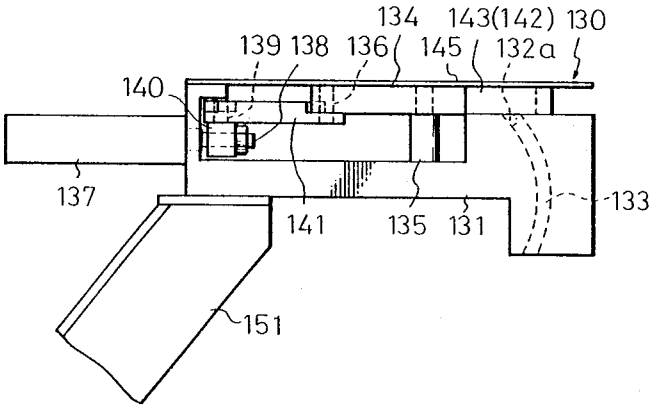
FIGS. 7A and 7B are side and plan views of the roving piecing head of the roving-piecing apparatus shown in FIGS. 1A and 1B.
Figure 7B:
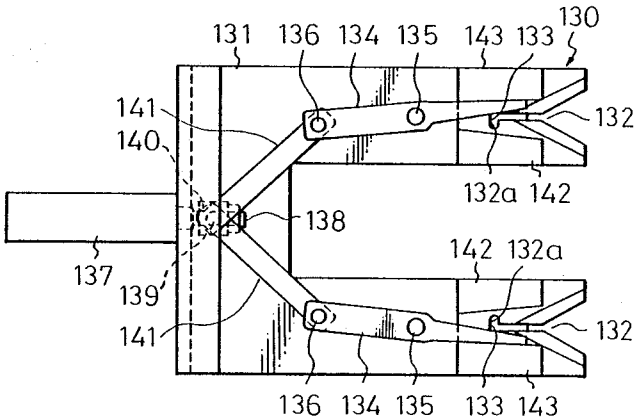
Figure 7C:
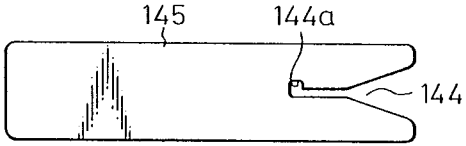
FIG. 7C is a plan view of a roving guide plate utilized for the roving-piecing apparatus shown in FIGS. lA and 1B.

The roving piecing head 130 will be described hereinafter with reference to FIGS. 7A, 7B and 7C.

Two roving piecing heads 130 are mounted symmetrically on a U-shaped roving piecing head body 131. The respective extremities of the roving piecing heads 130 are spaced apart by a distance equal to the interval between the condensing funnels 6 of the spinning frame on opposite sides of a top arm 5, respectively, and are able to reach a point near to the condensing funnels 6, respectively. Y-shaped roving guide grooves 132 are formed in the nose of the roving piecing head bodies 131 to guide rovings, respectively. Each roving guide groove 132 has a bottom surface finished in a smooth curved surface 133 as shown in FIG. 7A. Each of roving gripping levers 134, capable of reciprocally displacing across the respective roving guide grooves 132, is supported pivotally at a position near the middle thereof on a pin 135 secured to the roving piecing head body 131. A pin 136 is projected from the rear end of each roving gripping lever 134. A roving gripping pneumatic cylinder 137 is secured to the back side of the roving piecing head body 131, and a block 140 provided with a pin 139 is secured to the free end of a piston rod 138 of the pneumatic cylinder 137. The pin 139 and the pin 136 of the roving gripping lever are interconnected by a connecting bar 141. Pairs of nipping fingers 142 and 143 are secured to the upper surface of the roving piecing head body 131 on opposite sides of each roving guide groove 132, respectively. Roving guide plates 145, each provided with a Y-shaped roving guide groove 144 in the extremity thereof, are secured to the roving piecing head body 131 so as to extend over pairs of nipping fingers 142 and 143 and the back side of the roving piecing head body 131. A recess **144*a* is formed in the bottom surface of each roving guide groove 144 to prevent the roving of the full packaged roving bobbin 1 from escaping from the respective roving guide grooves 144, to prevent any possible contact of the rovings from the respective full packaged roving bobbins 1 with the rovings from the exhausted roving bobbins in process. A recess 132*a* is formed in the upper surface of each roving piecing head body 131 so as to guide the ends of the roving from the full packaged roving bobbins 1, which is gripped between the roving gripping levers 134 and the nipping fingers 142, to the bottoms 133 of the roving guide grooves 132 thereof. Air is supplied through a magnetic valve (not shown) to the pneumatic cylinder 137 to turn the roving gripping levers 134 about the respective pins 135 so that the roving gripping levers 134 are brought into engagement with the corresponding nipping fingers 143 to grip the rovings from the corresponding exhausted roving bobbins (FIG. 7B), the roving gripping levers 134 are brought into engagement with the corresponding nipping fingers 142 to grip the rovings from the corresponding full roving bobbins, or the roving gripping levers 134 are positioned at neutral positions where the roving gripping levers 134 are in engagement with neither the nipping fingers 142 nor the nipping fingers 143**, respectively.

Figure 8A:
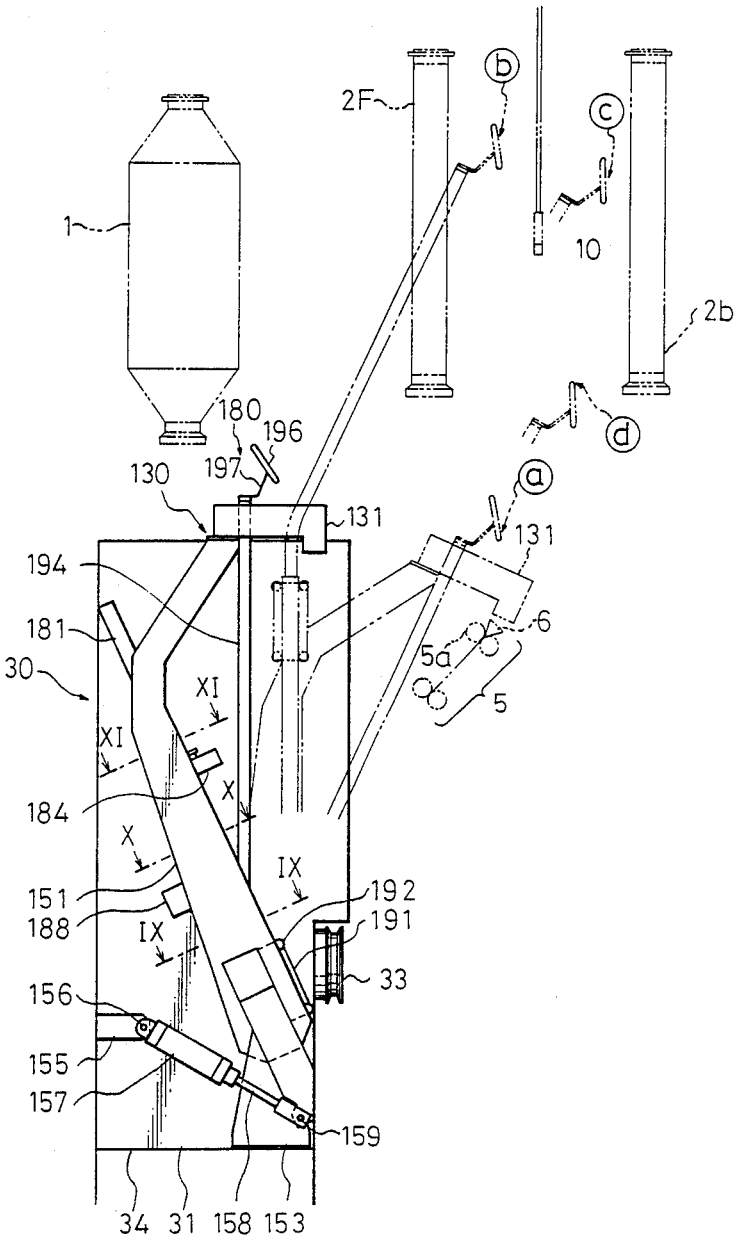
FIG. 8A is a side view of a roving introducing device of the roving-piecing apparatus shown in FIGS. 1A and lB.
Figure 8B:
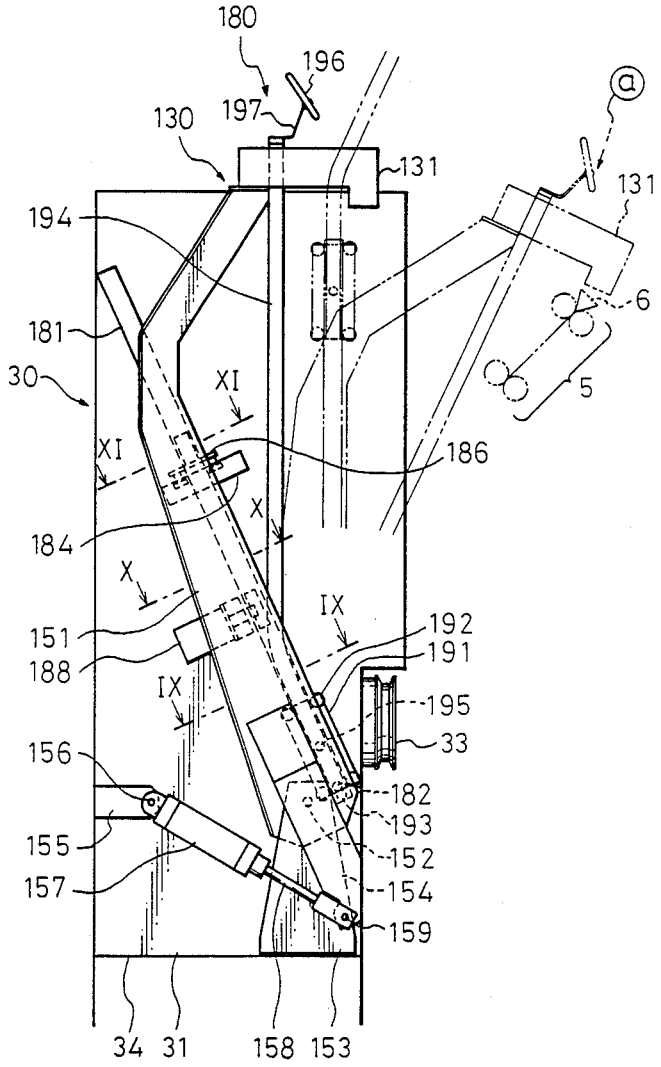
FIG. 8B is a side view of a part of the roving introducing device shown in FIG. 8A, which indicates the construction of the device in more detail.

The roving piecing head body 131 is secured to a roving piecing head supporting arm 151 having an L-shaped cross section, a supporting shaft 152 having a flange at the lower end thereof is rigidly disposed at the supporting arm 151 (FIG. 9), and the supporting shaft 152 is supported rotatably at journals 152*a* formed in the opposire ends thereof on supporting blocks 153 secured to a bse plate 34 of the roving piecing unit 31. A plate 154 is welded to the lower end of the supporting arm 15 (FIG. 8A), and the plate 154 is connected pivotally at the lower end thereof with a pin 159 to the piston rod 158 of a pneumatic cylinder 157 for turning the roving piecing head, pivotally supported with a pin 156 on a bracket 155 secured to the side plate of the roving piecing unit. When the pneumatic cylinder 157 is actuated so as to retract the piston rod 158 into the cylinder 157, the supporting arm 151 is turned on the supporting shaft 152; consequently, the roving piecing head 10 is moved from the standby position indicated by solid lines to the roving piecing position indicated by imaginary lines in FIGS. 8A and 8B. The supporting arm 151 is curved in a backward convex shape so that the supporting arm 151 does not interfere with the roving end catching members 89 of the roving end catching device 80 located at the standby position, when the supporting arm 151 is turned forward and the upper portion of the supporting arm 151 projects forward from the roving piecing unit 31 through a space between the two roving end catching members 89 respectively located at the standby positions (FIGS. 1 and 8B).

Figure 9:
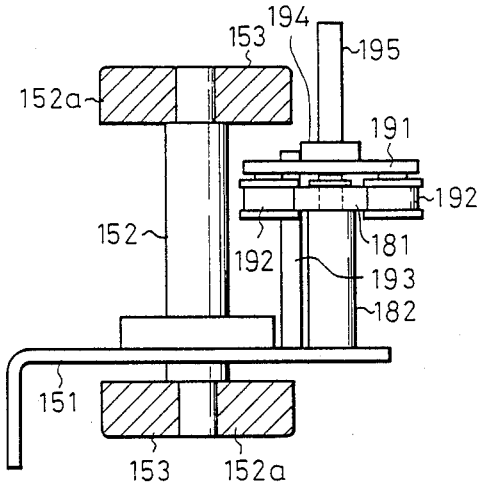
FIG. 9 is a sectional view of a part of the introducing device, taken along the line IX—IX in FIG. 8.
Figure 10:
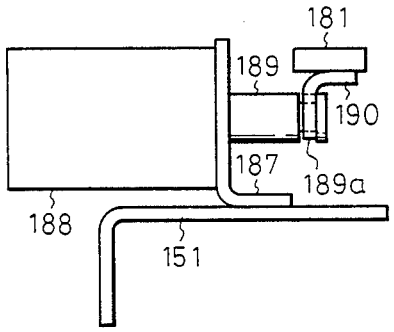
FIG. 10 is a sectional view of the other part of the introducing device taken along the line X—X in FIG. 8.
Figure 11:
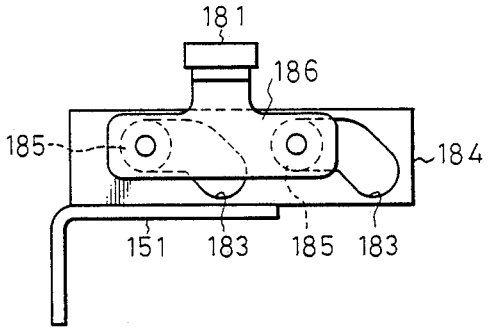
FIG. 11 is a sectional view of another part of the introducing device, taken along the line XI—XI in FIG. 8.
Figure 12A:
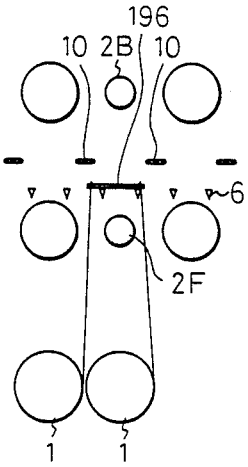
FIG. 12 is an explanatory drawing indicating the steps of the roving piecing operation, according to the present invention, by utilizing the working machine shown in FIGS. 1A and 1B, wherein the component drawings in the upper half portion thereof are plan views, and the component drawings in the lower half portion thereof are front views.
Figure 12B:
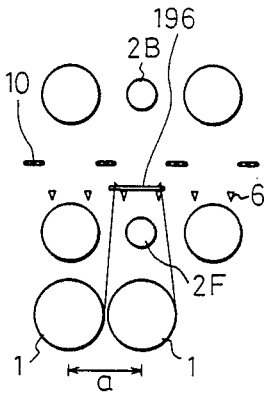
Figure 12B:
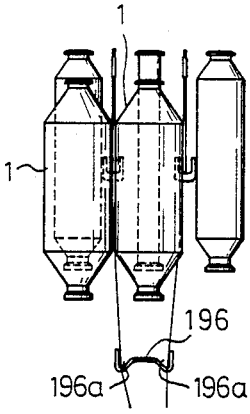
Figure 12B:
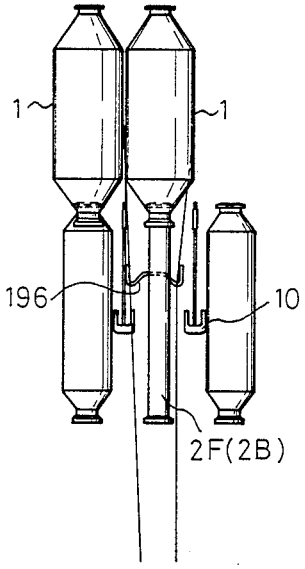
Figure 12C:
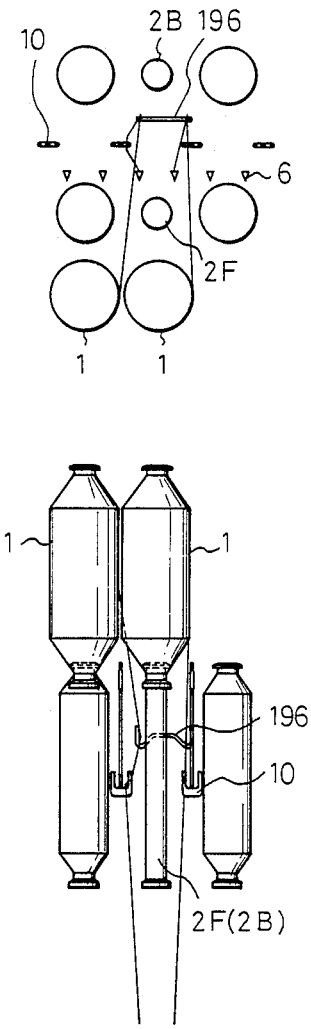
Figure 12D:
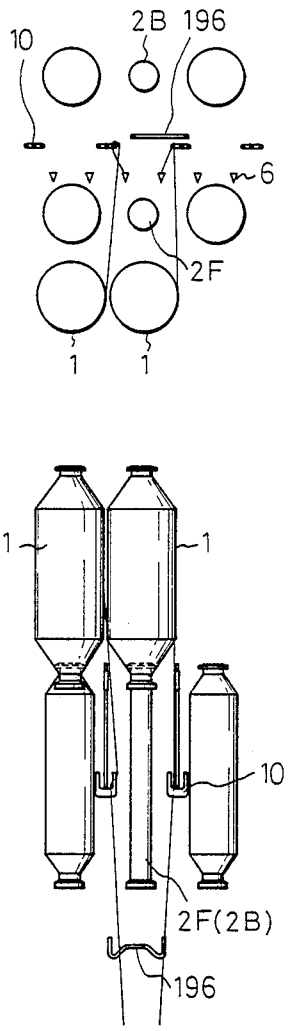

The roving introducing device 180 will be described hereinafter with reference to FIGS. 8A through 11. Referring to FIG. 9, a shaft 182 is fixed to the roving piecing head supporting arm 151, and slide bar 181 is supported at the lower end thereof on the shaft 182 by suitable means such as a ball bearing, and thus can be tilted and turned. As shown in FIG. 11, cam plate 184 provided with two cam grooves 183 of the same shape is secured to the middle part of the supporting arm 151, and a bracket 186 pivotally supporting two cam followers 185 respectively engaging the cam grooves 183 is secured to the back of the slide bar 181. As shown in FIG. 10, a pneumatic cylinder 188 for turning the roving introducing bar is secured to a bracket 187, which is rigidly connected to the supporting arm 151. A stopping member 190 received in a groove 189*a* formed in the free end of a piston rod 189 of the pneumatic cylinder 188 is secured to the slide bar 181. When the pneumatic cylinder 188 is actuated so as to project the piston rod 189, the slide bar 181 is turned forward on the shaft 82 and is moved laterally by the cam grooves 183. As shown in FIGS. 8B and 9, four flanged rollers 192 pivotally supported on the slide plate 191 slidably support the slider bar 181 therebetween so that slide plate 191 can slide along the slide bar 181, and the slide Plate 191 is stopped at a position corresponding to the lower end of the slide bar 181 with the lower end thereof in contact with a stopper pin 193 planted in the supporting arm 151 (FIG. 8B). A roving introducing bar 194 and a pin 195 are secured to the surface of the slide late 191. The roving introducing bar 194 extending upward has an L-shaped upper portion as shown in FIGS. 1A, 1B, 8A. A roving guide member 196 having two guide hook portions 196*a* (FIG. 12A) for guiding respective rovings is rigidly mounted on the extremity of the roving introducing bar 194 with a holding member 197 (FIGS. 1A, 1B, 8A and 8B). The distance between the guide nook portions 196*a* of the roving guide member 196 is slightly smaller than the interval between the respective hook portions of the two adjacent anchor-shaped roving guides 10, to which a pair of rovings are introduced. The guide hook portion 196*a* at the right side a viewed in FIGS. 1A and 1B (the left side guide hook portion in FIG. 12) is positioned in front of the hook portion of the corresponding roving guide 10. When the pnumatic cylinder 157 for turning the roving introdcing head is actuated so as to turn the supporting arm 151 forward on the supporting shaft 152, the pin 195 of the slide plate 191 engages the engaging part 56*a* of the ar member 56 held in an upright condition on the slide member 53 of the full roving packaged bobbin supporting head 40, whereby the slide plate 191 is raised as the slide member 53 is lifted up. In this embodiment, the full roving packaged bobbin supporting head 40 can be lifted individually when the roving piecing head 130 is at the standby position, and the roving introducing device 180 can be lifted synchronously with the full packaged roving bobbin supporting head 40 when the roving piecing head 130 is at the roving piecing position, namely, at the front terminal of the forward displacement thereof.

Next, the construction and function of the roving bobbin exchanging apparatus 200 are hereinafter explained in detail with reference to FIGS. 1A, 1B, 2 and FIG. 14–18.

Figure 14:
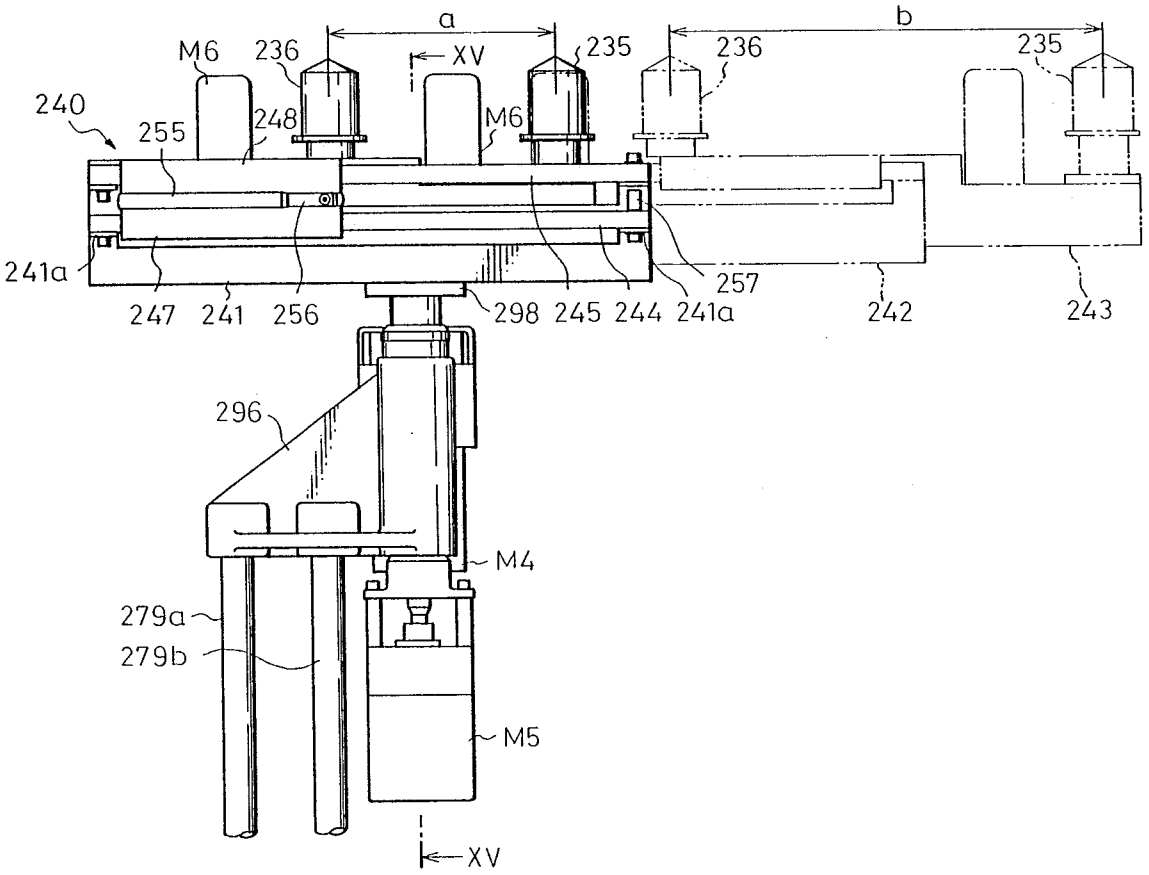
FIG. 14 is a side view of a peg unit utilized for the roving bobbin exchanging apparatus of the working machine shown in FIGS. 1A and 1B, wherein the entire portion thereof is indicated.

A shown in FIGS. 1A, 1B and 14, in the roving bobbin exchanging apparatus 200 mounted on the working machine 30, which is a preferable embodiment of the present invention, a peg unit 240 is rigidly mounted on a peg unit supporting member 296, and the peg unit 240 is provided with a pair of pegs 235, 236 and a telescopic mechanism by which the axial distance between these pegs 26 and 236 can be changed to a first distance identical to an axial distance (a) between two adjacent bobbin hangers of the supply rail and to a second distance identical to an axial distance between a front bobbin hanger and a back bobbin hanger, which are facing each other in the creel of a spinning frame. A pair of support rods 279*a*, 279*b* which are vertically secured to the pe unit supporting member 296, are secured by their bottom ends to a lifting member 277 respectively. The lifting member 277 is slidably supported by a pair of supporting pillars 275*a* and 275*b* which are vertically secured to a pair of supporting brackets 273*a*, 273*b*. Bracket is secured to the base plate 34 of the working machine 30, while the bracket 273*b* is secured to the top portion of the working machine 30. A chain 276 is extended around a chain wheel 274, which is secured to a motor shaft of a motor 3 for lifting the peg unit 240 by a key (not shown). and a chain wheel (not shown), which shaft is rotatably supported by the supporting bracket 273*b*, and the lifting member 277 is connected with both end portions of the chain 276. The motor M3 is rigidly mounted on the base plate 34 of the working machine 30. Accordingly, the lifting member 277 can be displaced upward or downwards in accordance with the normal rotation or reverse rotation of the motor M3. The peg unit supporting member 296 supporting the peg unit 240 is also displaced upwards or downwards according to the above-mentioned lifting motion of the lifting member 277, respectively.

Figure 15:
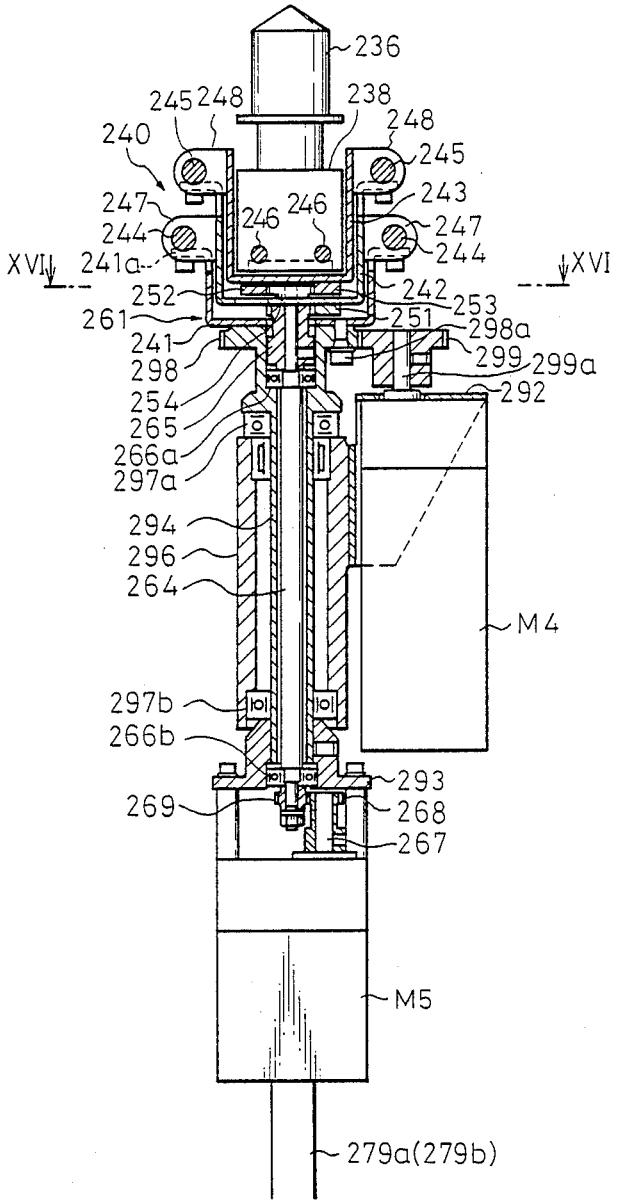
FIG. 15 s a sectional view of the peg unit taken along the line XV—XV in FIG. 14.
Figure 16:
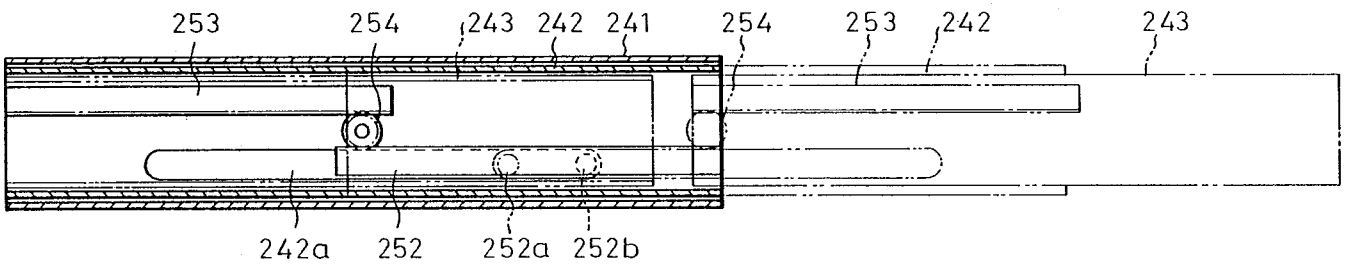
FIG. 16 is a schematic plan view of a telescope mechanism utilized for the peg unit shown in FIG. 14.
Figure 17A:
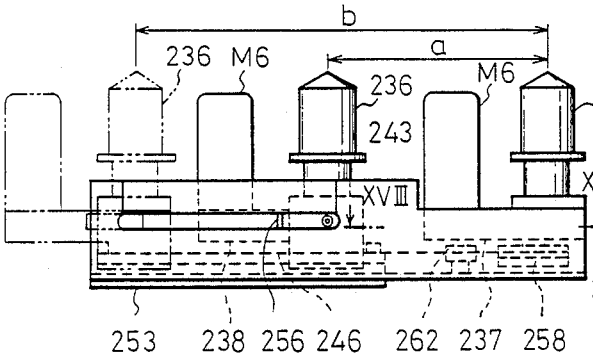
FIGS. 17A and 17B are side view and front view of a second slider of the peg unit shown in FIG. 14; respectively.
Figure 17B:
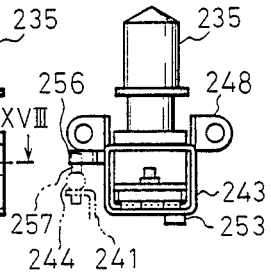
Figure 18A:
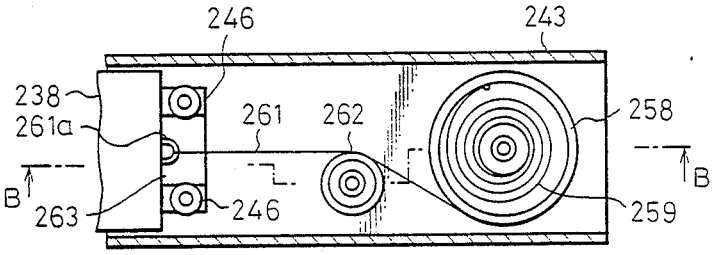
FIG. 18A is a sectional view of the second slider, taken along the line XVIII—XVIII in FIG. 17A.
Figure 18B:
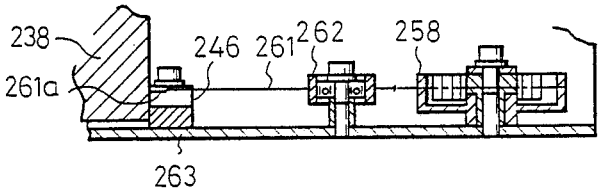
FIG. 18B is a sectional view of the second slider shown in FIG. 18A, taken along the line B—B in FIG. 18A.

Referring to FIGS. 14 and 15, a hollow shaft 294 is journaled in bearings 297*a* and 297*b* on the supporting member 296, and a motor M4 for turning the peg unit 240 is secured to the supporting member 296. A drive shaft 264 extended through the hollow shaft 294 has an upper end which is rotatably supported in a bearing 266*a* on the hollow shaft 294 and a lower end of the hollow shaft 294 is secured to the supporting bracket 293, and the lower end portion of the drive shaft 264 is rotatably supported in a bearing 266*b* on the lower supporting bracket 293. A motor M5 for displacing the peg unit 240 forwards or backwards is suspended rigidly from the lower bracket 293 by bolts. A drive gear 268 secured to an output shaft 267 of the motor M5 and a gear 269 secured to the lower end of the drive shaft 264 are meshed and a peg unit drive gear 265 is secured to the upper end of the drive shaft 264.

A gear 298 having a large diameter is formed integrally with the upper end portion of the hollow shaft 294, and a slide base 241 is fastened with bolts to the gear 298. As shown in FIGS. 14 and 15, the peg unit 240 comprises the slide base 241 secured to the hollow shaft 294, a first slider 242 which is capable of sliding on the slide base 241, and a second slider 243 which is capable of sliding on the first slider 242. The slide base 241 has a U-shaped cross section, and the opposite longitudinal ends (the right and left ends as shown in FIG. 14) of the slide base 241 are bent outward to for lugs 241*a*. First rods 244 are fastened to the upper surfaces of the lugs 41*a* with bolts, and one of the bolts fastening the first rods 244 to the lugs 41*a*, which is positioned at a forward side, projects upward to also serve as a stopper pin 257. A second rack 252 is secured through collars 52*a* and 52*b* (FIG. 16) to the upper surface of the slide base 241. The first slider 242, an well as the slide base 241, has a U-shaped cross section, and second rods 245 are fastened to lugs formed in the first slider 242 at the opposite longitudinal ends thereof with bolts. Bearing parts 247 projecting from the opposite sides of the first slider 241 are slidably engaged with the first rods 244 therethrough. A first rack 251 meshing with the gear 265 of the drive shaft 264 is fastened to the lower surface of the first slider 242, and a pinion 254 is supported rotatably on the upper surface of the first slider 242. The pinion 254 meshes with the second rack 252 and a third rack 253 secured to the lower surface of the second slider 243 (FIG. 15). An elongated slot 242*a* is formed in the bottom wall of the first slider 242 to enable the second rack 252 to move without interfering with the first slider 242. The second slider 243 also has a U-shaped cross section. Bearing parts 248 projected from the opposite sides of the second slider 243 slidably support the second rods 245 therethrough.

The construction of the peg 235 and the peg 236 is similar to that of the pegs 42 of the full packaged roving bobbin supporting head 40 shown in FIG. 4, and they can be rotated by the corresponding motors M6 for rotating the respective pegs, which are rigidly mounted on the corresponding peg barrels 237, 238, respectively. The peg barrel 237 of the peg 235 is rigidly mounted on an upper surface at the front end portion of the second slider 43, while the peg barrel 238 of the peg 236 is slidably mounted on third rods 246 secured to an upper surface of a bottom plate of the second slider 243. Further, as shown in FIGS. 17A, 17B, 18A, 18B, a wire drum 258 provided within the second slider 243 is urged in a winding direction, to wind a wire 261, by a spiral spring 259. The wire 261 is extended via a guide roller 262, and one free tip end thereof is connected to a wire hook 261*a* secured to the front side of the peg barrel 238. Accordingly, the peg barrel 238 of the peg 236, which is slidable along the third rods 246, is pulled forward and the sliding motion of the peg 236 is stopped by contact with a stopper 263 secured to the second slider 264 which functions as a seat for the third rods 246, so that the position of the peg 236 is regulated. In this condition, the axial distance between the pegs 236 and 237 is identical to the axial distance a between the adjacent bobbin hangers on the supply rail 13. An engaging member 256 is secured to the side surface of the peg barrel 238 so as to project into a space between a bearing part 247 of the first slider 242 and a bearing part 248 of the second slider 243.

Thus, the first slider 242 and second slider 243 of the peg unit 240 can be advanced and retracted telescopically. That is, when the motor M5 for displaying the peg unit 240 forwards or backwards is actuated, the rotative power of the motor M5 is transmitted through the gears 268 and 269 to the drive shaft 264 to rotate the drive gear 265. Consequently, the fist slider 242 is advanced by sliding along the slide base 242, and the pinion 254 supported on the first slider 242 meshing with the second rack 252 is caused to rotate while moving together with the first slider 242. Since the pinion 254 rotates about the center thereof while moving linearly together with the first slider 242, the circumferential speed of the pinion 254 is twice the linear speed of the first slider 242, and since the third rack 253 secured to the second slider 243 meshes with the pinion 254, the second slider 243 slides forward on the first slider 242 at a linear speed twice the linear speed of the first slider 242. While the first slider 242 and the second slider 243 are thus advanced, the engaging member 256 secured to the peg barrel 238 of the peg 236 comes into contact with the stopper pin 257 so that a further advance of the peg barrel 238 is stopped. The first slider 242 and the second slider 243 are advanced further while the peg barrel 238 of the peg 236 moves backward relative to the second slider 243 against the resilient force of the spiral spring 258. When the first slider 242 and the second slider 243 arrive, respectively, at the front end of their forward motion, as indicated by imaginary lines in FIGS. 14 and 16, the axial distance b between the pegs 35 and 36 becomes equal to the distance b between a front bobbin hanger and a back bobbin hanger facing each other, on the creel of the spinning frame. During retraction, the peg barrel 238 of the peg 236 comes into contact with the stopper 263 of the second slider 243 and, thereafter, the fist slider 242 and the second slider 243 retract, respectively, to standing positions as indicated by solid lines in FIG. 14, while the axial distance between the pegs 235 and 236 is maintained at the distance a.

In the above-mentioned embodiment, the above-mentioned axial distance between two pegs 235 and 236 is maintained at the distance a by bringing the peg barrel 238 of the peg 236 in contact with the stopper 263, by providing the urging force toward the forward direction created by the spiral spring 258 thereto. However, instead of utilizing this spiral spring 258, the following modification can be applied: a stopper is secured to the first slider 242 so that it will come into contact with the engaging member 256 of the peg barrel 238, and accordingly, the stopper 256 comes into contact with the above-mentioned stopper of the first slider 242 in the backward displacing motion thereof, and therefore, the axial distance between the pegs 235 and 236 can be gradually reduced during the backward displacement thereof under the above mentioned condition. Then, finally, at the end of the backward displacing motion thereof, which is the stand-by position thereof, the axial distance between pegs 235 and 236 become the distance a.

As shown in FIG. 15, a gear 299 is rigidly mounted on a motor shaft 299*a* of the motor M4 by a key, which is a motor for turning the peg unit 240 secured to the peg unit supporting member 296, and the gear 299 meshes with the large gear 298 of the hollow shaft 294 disposed at the slide base 241. Therefore, the peg unit 240 can be turned in a desirable direction about the hollow shaft 294 by rotating the motor M4 in the normal or reverse direction.

For the operation of the above-mentioned roving piecing apparatus 100, the roving introducing apparatus 180, and the roving bobbin exchanging apparatus 200, in the respective predetermined cycles, a power board, electric or electronic devices, compressor, several known control devices, which are indicated as a whole by a reference numeral 300, is mounted on a machine body 31 of the working machine 30.

Figure 20:
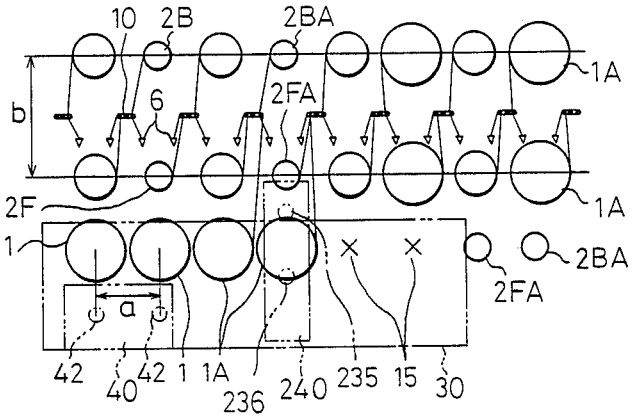

Next the operation by the working machine 30 is explained in detail. Before starting the spinning operation, a pair of half exhausted roving bobbins, and a pair of full packaged roving bobbins are alternately suspended by pairs of bobbin hangers 12, one hanger 12 being is positioned on a front row, while the other is positioned on a back row, facing each other, on the creel of the spinning frame 3, from one end of the spindle alignment to the other end thereof. After this preparation, the spinning operation is started, and when each pair of the above-mentioned half exhausted roving bobbins becomes almost exhausted respectively, the working machine 30 is displaced to the working position thereof in front of the spinning frame 30 so as to carry out the roving piecing operation and the roving bobbin exchanging operation thereby. The exhausted roving bobbin of front row and the exhausted roving bobbin of back row are hereinafter identified as 2F and 2B, respectively. The working machine 30 is first stopped at the position in front of a first pair of exhausted roving bobbins 2F and 2B so as to carry out the first roving piecing operation applied to the above mentioned first pair of exhausted roving bobbins 2F and 2B (FIG. 20), and after completion of the first roving piecing operation, then the working machine 30 is displaced to next working position of the working machine 30, where the second roving piecing operation is applied to the next pair of exhausted roving bobbins 2F and 2B, while the first roving bobbin exchanging operation is applied to the above-mentioned first pair of exhausted roving bobbins 2F, 2B at which the roving piecing operation has been completed, and these two operations are stepwisely but successively carried out for all of the pairs of exhausted roving bobbins from one end to the other end of the spindle alignment of the spinning frame. It is important to recognize that, in the above-mentioned operation, in each unit the integrated operations by the roving-piecing apparatus 100 and the roving bobbin exchanging apparatus 200 are carried out in parallel and at the same time.

As mentioned above, in each working position of the working machine, a pair of roving-piecing head bodies 131 of the apparatus 100 and a pair of roving end catching members 89 are facing the corresponding trumpets 6, respectively, to which rovings from the almost exhausted roving bobbins 2F, 2B are supplied while a pair of pegs 42 are facing the corresponding full packaged roving bobbins 1 suspended by two adjacent bobbin hangers 15 of the supply rail 13. On the other hand, a pair of pegs 235 and 236 of the roving bobbin exchanging apparatus 200 are facing the corresponding exhausted roving bobbins 2FA and 2BA, respectively, at which the roving piecing operations have been completed, respectively, by the apparatus 100. However, at the first stopping position of the working machine 30, the above-mentioned pegs 235 and 236 remain idle, while at the last stopping position of the working machine 30, the roving piecing head bodies 131 and the roving end catching members 81 remain idle.

For a better understanding of the present invention, the roving piecing operation by the apparatus 100 is first explained in detail.

First, the output shaft of the motor M2 for lifting the pegs is rotated in the normal direction and then in the reverse direction, so that the slide member 53 is raised and then lowered as mentioned above, then displaced to the standby position shown in FIG. 3 in a condition such that the full packaged roving bobbins 1 are supported by the full packaged bobbin supporting head 40, after receiving them from the two adjacent bobbin hangers 15 on the supply rail 13. The rotary actuator 102 is turned in the normal direction to shift the roving end catching members 89 of the roving end catching device 80 to the upper position indicated by imaginary lines in FIG. 6, and then the double-rod pneumatic cylinder 110 is actuated to advance (movement to the right as viewed in FIG. 5) the cylinder body 114; consequently, the nozzles 89*a* of the roving end catching members 89 are moved by the cam surface of the plate cams 118 and displaced along the surface of the full packaged roving bobbin 1, which is the frontmost one of the pair of full packaged roving bobbins 1 subjected to the unit operation for piecing rovings. Simultaneously with the arrival of the cylinder body 114 at the front limit position (the right end of the stroke as viewed in FIG. 5), the nozzles 89*a* of the roving end catching members 89 are positioned at the respective positions facing the outer circumferences of the corresponding full packaged roving bobbins 1, in close proximity thereto, respectively, as indicated by the imaginary lines II in FIG. 6. In this condition, the blower 95 is actuated and the output shaft of the motor M1 for rotating the pegs is turned by approximately one turn in the unwinding direction of the roving bobbins, whereby the roving ends of the full packaged roving bobbins 1 are sucked out by the nozzles 89*a* of the respective roving end catching members 89. Then, after the cylinder body 114 has been retracted (movement to the left as viewed in FIG. 5) while the output shaft of the motor M1 is rotated in the unwinding direction of the roving bobbins, the rotary actuator 102 is reversed to return the roving end catching members 89 to the respective standby positions. The respective tip end portions of the roving end catching members 89 are formed in a flat shape. When the nozzles 89a pass the extremity of the roving piecing head body 131 of the roving piecing head 130, the nozzles 89a pass through the respective triangular spaces of the corresponding Y-shaped roving guide grooves 132, respectively. Accordingly, the rovings pulled out from the respective full packaged roving bobbins 1 are guided into the corresponding roving guide grooves 132 without fail. At the respective standby positions, the respective nozzles 89a of the roving end catching members 89 are positioned below and behind the respective bottoms 133 of the corresponding roving guide grooves 132 (lower left-hand position in FIG. 6) and pull the rovings by suction, and the rovings pulled out from the respective full roving bobbins are pressed tight against the respective curved bottoms 133 of the corresponding roving guide grooves 132, respectively. In this condition, the roving gripping pneumatic cylinder 137 is actuated so as to project the piston rod 138 thereof to grip the rovings of the full packaged roving bobbins between the respective combinations of the gripping lever 134 and the nipping finger 142, respectively, so that the rovings slip into the respective recesses 144a of the corresponding roving guide plates 145, respectively. After the rovings of the full packaged roving bobbins 1 have been gripped, the rotary actuator 102 is turned in the normal direction to move the nozzles 89a of the roving end catching members 89 upward near to the corresponding roving gripping levers 134 (a position indicated by imaginary lines III in FIG. 6) and, immediately, the rotary actuator 102 is reversed to return the roving end catching members 89 again to the respective standby positions. Consequently, the free end of the rovings gripped by the respective roving gripping levers 134 are combed from the rovings, with the needle 92 arranged in the form of a comb on the inner surface of the upper wall of each nozzle 89a, whereby the free end of the rovings are tapered. The roving ends combed from the rovings are sucked into the filter box 94.

Then, the output shaft of the peg rotating motor M2 is rotated again in the unwinding direction, while the pneumatic cylinder 157 for swinging the roving piecing head 130 is actuated so as to retract the piston rod 158 thereof to shift the roving piecing head body 131 of the roving piecing head 130 to the roving piecing position above the trumpet 6. Consequently, the rovings from the exhausted roving bobbins 2F and 2B in process are guided into the respective roving guide grooves 132 of the corresponding roving piecing head body 131 to each bottom 133 thereof until arriving at the roving piecing position, namely, the front terminal position, and the rovings of the exhausted roving bobbins 2F and 2B in process are pressed against the corresponding rovings from the full packaged roving bobbins 1, which are gripped by the respective roving gripping levers 134 while hanging from the curved bobbin thereof, so that these rovings from the exhausted roving bobbins 2F, 2B are overlapped with the corresponding rovings from the full packaged roving bobbins 1, respectively. Then, the roving gripping pneumatic cylinder 137 is actuated so as to turn the roving gripping lever 134 to the respective neutral positions to release the rovings from the full roving bobbins from the roving gripping levers 134. Then, the rovings from the full packaged roving bobbins 1 are introduced into the corresponding trumpets 6 together with the corresponding rovings of the exhausted roving bobbins 2F and 2B, respectively. After the free ends of the rovings from the full packaged roving bobbins 1 have been nipped by the back rollers of the drafting parts, the roving gripping pneumatic cylinder 137 is actuated to further turn the roving gripping levers 134, so that each roving from the exhausted roving bobbin is gripped between the corresponding roving gripping lever 134 and the nipping finger 143. Consequently, each roving from the exhausted roving bobbins 2F and 2B is stretched between the corresponding roving gripping lever 134 and the back roller of the drafting part, and thereby the rovings of the exhausted roving bobbins 2F and 2B extending behind the respective piecing positions are cut off, and thus the roving piecing operation is completed.

Thus, when the roving piecing head 130 is swung forward to the roving piecing position, the pin 195 of the slide plate 191 can engage the actuating part 56a of the arm member 56 of the full roving packaged bobbin supporting head 40. Therefore, the slide member 53 is moved vertically to return the full packaged roving bobbins 1, which have been subjected to the roving piecing operation, to the bobbin hangers 15 on the supply rail 13 and the roving introducing operation for introducing the rovings from the full packaged roving bobbins 1 to the corresponding roving guides 10. The front views in the lower half portion in FIGS. 12A to 12D correspond to front views at positions (a) to (d) indicated by imaginary lines in FIG. 8A, respectively, and plan views shown in the upper half portion in FIGS. 12A to 12D correspond to plan views at the same positions, respectively. The roving introducing operation will be described hereinafter with reference to FIGS. 8A, 8B, 12A to 12D and 13.

Upon the completion of the roving piecing operation, the roving gripping levers 134 are turned to the neutral positions to release the rovings from the exhausted roving bobbins 2F and 2B, and the output shaft of the peg lifting motor M2 is rotated in the normal direction while the output shaft of the peg rotating motor Ml is rotated in the unwinding direction for a predetermined time. Consequently, the slide plate 191 is raised together with the slide member 53 to raise the roving guide members 196 attached to the roving introducing bar 194 from the position ⓐ to the position ⓑ (FIGS. 8A, 8B). Since the roving guide members 196 are disposed above the roving piecing head body 131 of the roving piecing head 130, the rovings from the full packaged roving bobbins 1 are guided into the respective guide hooks 196a of the corresponding roving guide members 196 during the swinging motion of the roving piecing head 130 from the standby position to the roving piecing position, and the rovings from the respective full packaged roving bobbins 1 are hooked on the corresponding roving guide members 196 before the roving piecing head 130 arrives at the roving piecing position (the position ⓐ). Accordingly, when the roving guide member 196 is raised from the position ⓐ to the position ⓑ, the rovings from the respective full packaged roving bobbins 1 also are raised by the respective guide hooks 196a of the roving guide member 196. When these rovings reach the upper positions ⓑ thereof, the roving guide member 196 is located between the front exhausted roving bobbins 2F and an alignment of corresponding two adjacent roving guides 10 for guiding the respective rovings from the corresponding two full packaged roving bobbins 1. In this condition, in the plan view, these two rovings from these two full packaged roving bobbins pass through the respective guiding positions in front of the respective anchor-shaped hooks of the corresponding roving guides 10, while in the front view, these two rovings from the respective full packaged roving bobbins, which have been engaged with the corresponding adjacent two bobbin hangers 15 of the supply rail 13 respectively, pass the above-mentioned guiding position above the above mentioned respective anchor-shaped hooks of the corresponding roving guides 10 respectively. Then, the pneumatic cylinder 188 for turning the roving introducing bar 194 is actuated so as to project the piston rod 189 thereof to swing the slide bar 181 forward, and thereby the roving introducing bar 194 is caused to swing together with the slide bar 181. Consequently, the roving guide member 196 is shifted from the position ⓑ to the position ⓒ between the alignment of the above-mentioned roving guides 10 and the back exhausted roving bobbin 2B. Since the slide bar 181 swings along the cam grooves 183 of the cam plate 184, the roving guide member 196 swings substantially straight up above the hooks of the roving guides 10, passes over the respective hooks of the corresponding roving guides 10, and then moves laterally to the right when viewed from the front of the spinning frame.

According to the above-mentioned motion, the roving from the full packaged roving bobbin at the left side in the drawing passes over the corresponding roving guide 10, having a pair of upright elements projected upward from both sides thereof, in a condition such that the roving passes through the space between these upright elements in the hooked condition to the right side projected element, while the roving from the full packaged roving bobbin at the right side in the drawing passes through the space between the above-mentioned two roving guides 10 while being urged to the left side of the projected element of the right side roving guide 10 in the drawing. In the above-mentioned condition, the roving is unwound from the corresponding full packaged roving bobbin 1 and passes through the correspondings hook portion 196*a* of the roving guide member 196, and then passes through the corresponding roving guide 10 in the above-mentioned condition, and thereafter, runs to the corresponding trumpet (not shown in the front view) as shown in the front view of FIG. 12C. Then, the peg lifting motor M2 is actuated to rotate in the reverse direction to lower the slide member 53, so that the two full packaged roving bobbins 1 are separated from the respective pegs 42, so that these full packaged roving bobbins 1 are suspended by the respective bobbin hangers 15 of the supply rail 13, and the slide plate 191 is lowered together with the slide member 53. Consequently, the roving guide members 196 are lowered. While the roving guide members 196 are being lowered, the pneumatic cylinder 188 for swinging the roving introducing bar 194 is actuated so as to retract the piston rod 189 thereof when the roving guide members 196 reach the position ⓓ in FIGS. 8A, 8B, to return the roving guide members 196 to the position ⓐ in FIGS. 8A, 8B. As the- roving guide members 196 are moved via a passage c → d → ⓐ, the rovings of the full packaged roving bobbins and the respective hooked portions 196*a* of the roving guide members 196 are transferred from the roving guide member 196 to the corresponding roving guides 10, respectively, to feed the rovings of the full packaged bobbins 1 suspended by the two adjacent bobbin hangers 15 of the supply rail 13 through the corresponding roving guides 10 into the drafting zone.

Figure 13:
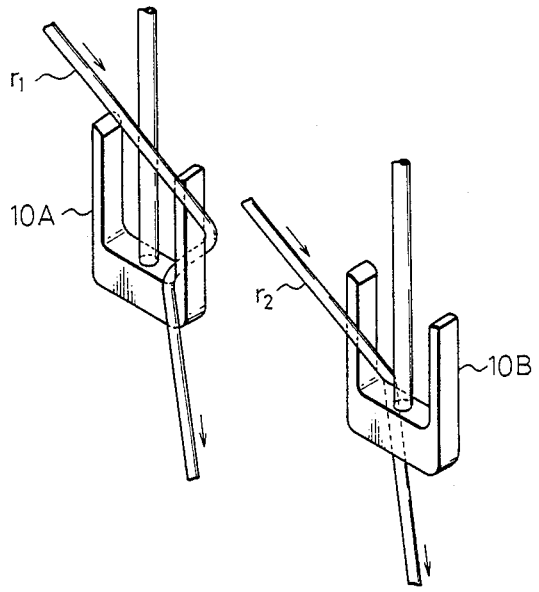
FIG. 13 is a perspective view of a pair of roving guides indicating the condition immediately after completion of the operation of introducing a pair of rovings into the respective roving guide, according to the present invention.

As shown in FIG. 13, in the above-mentioned condition (d), the roving $r_1$ from a full packaged roving bobbin 1, which is a roving bobbin for exchanging the exhausted roving bobbin 2B suspended by the bobbin hanger of the back row in the creel, is hooked by the right side upwardly projected element of the left side roving guide 10A and then guided downward to the trumpet (not shown) of the corresponding draft part so that the roving $r_1$ is hooked to the front side edge (in the drawing) of the guiding surface of the roving guide 10A, while the roving $r_2$ from a full packaged roving bobbin 1, which is a roving bobbin for exchanging the exhausted roving bobbin 2F suspended by the bobbin hanger of the front row in the creel, passes the space between the upwardly projected elements of the roving guide 10B and is then guided downward to the trumpet (not shown) of the corresponding draft part. In this condition the roving $r_2$ is hooked to the back side edge (in the drawing) of the guiding surface of the roving guide 10B. Note, FIG. 13 shows the view from the outside of the spinning frame. Accordingly, the back exhausted roving bobbin 2B is replaced with the left full packaged roving bobbin 1 in the drawing in the hooked condition of the roving therefrom by the corresponding roving guide 10 as shown in FIG. 13. Accordingly, when the above-mentioned unit operation of exchanging roving bobbins is completed, the roving from the full packaged roving bobbin of the back row in the creel passes through the space between the above-mentioned two upwardly projected elements of the corresponding roving guide 10 and is guided downward to the trumpet of the corresponding draft part in the hooking condition by the front edge of the guide surface of the roving guide 10, while the roving from the full packaged roving bobbin of the front row in the creel passes through the space between the above-mentioned two upwardly projected elements of the corresponding roving guide 10 and is guided downward to the trumpet of the corresponding draft part in the hooking condition by the back edge of the guide surface of the roving guide 10. In the above-mentioned explanation, the expressions "front" and "back" denote the respective sides when viewed from in front of the spinning frame. After the roving guide members 196 have been returned to the position ⓐ, the piecing head swinging pneumatic cylinder 157 is actuated so as to project the piston rod 158 thereof to return the roving piecing head 130 to the standby position and to shift the roving gripping levers 134 from the neutral positions to positions where the roving gripping levers 134 engage the nipping fingers 143, respectively.

In the above-mentioned embodiment, in each unit operation, a pair of full packaged roving bobbins 1, suspended by two adjacent corresponding bobbin hangers 15 of the supply rail 13, are displaced to the respective pegs 42 of the supporting head 40 respectively, and after carrying out the above-mentioned unit roving-piecing operation at the standby position of the supporting head 40, the full packaged roving bobbins 1, at which the roving piecing operations have been completed, are returned to the supply rail 13. However, in a modification of the roving piecing operation, the unit roving piecing operation is applied while suspending the above-mentioned full packaged roving bobbins by respective rotatable bobbin hangers of the supply rail 13, which is arranged at a pertinent position in front of the creel. In this modification, the following additional mechanisms are needed for catching a roving end from each one of the above-mentioned full packaged roving bobbins and for introducing these rovings to the respective position for carrying out the piecing operation of the rovings. That is, a mechanism for turning each of the above-mentioned full packaged roving bobbins in the unwinding direction, for example, a device for driving each one of these full packaged roving bobbins by working to the bottom end portion of each of these full packaged roving bobbins, is mounted on the main body of the working machine in a condition such that it can be displaced upwards and downwards so that the catching member 89 can face the corresponding full packaged roving bobbins to catch a roving end therefrom, and then this roving end caught by the catching member 89 is carried to the corresponding position for carrying out the piecing operation, as explained in the above-mentioned embodiment, and then the roving piecing operation is carried out as explained in the above-mentioned embodiment. Accordingly, when such a modification is applied to the roving piecing operation, the above-mentioned roving introducing operation can be carried out while the above-mentioned full packaged roving bobbins are suspended by the corresponding bobbin hangers of the supply rail.

Next, the roving bobbin exchanging operation carried by the roving bobbin exchanging apparatus 200 is hereinafter explained with reference to FIGS. 20A to 20H.

As already explained, the peg unit 240 is displaced upward and downward according to the normal or reverse rotation of the peg unit lifting motor M3, and the peg unit 240 can be turned about the hollow shaft 94 by the rotation of the motor M4 which functions to turn the peg unit 240. Further, the normal rotation of the motor M5, which actuates the telescopic mechanism, mentioned already, which causes the peg unit 240 to displace the component elements forward, and during such forward displacement motion of the component elements of the peg unit 240, the axial distance between the pegs 235 and 236 is increased, and at the end of the above-mentioned forward displacement motion, the axial direction between these two pegs 235 and 236 becomes the axial distance b between a front bobbin hanger and a back bobbin hanger, facing each other in the creel, and by the reverse rotation of the motor M5, the component elements of the peg unit 240 are displaced backwards respectively, by the action of the telescopic mechanism, so that the axial distance between two pegs 235 and 236 is returned to the distance identical to the distance a between the two adjacent bobbin hangers 15 of the supply rail 13. The roving bobbin exchanging operation is explained hereinafter based upon the above-mentioned motion of the peg unit 240.

Figure 19A:
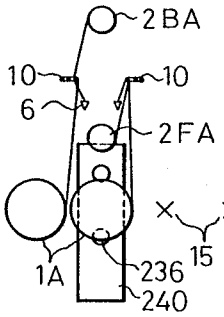
FIG. 19 is an explanatory drawing indicating the steps of the roving bobbin exchanging operation according to the present invention by utilizing the working machine shown in FIGS. 1A and 1B; and, FIG. 20 is a schematic plan view for explaining the relationship between the roving bobbin exchanging apparatus shown in FIG. 14, the operation position, the creel of the spinning frame, and the roving bobbins suspended by the respective bobbin hangers of the supply rail.
Figure 19B:
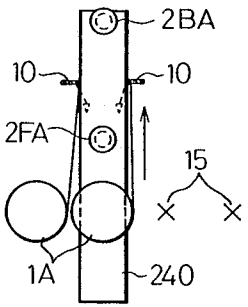
Figure 19C:
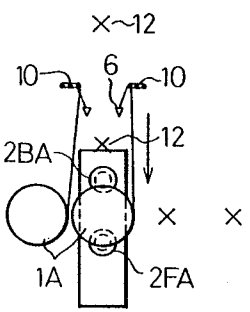
Figure 19D:
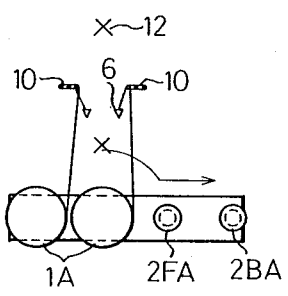
Figure 19E:
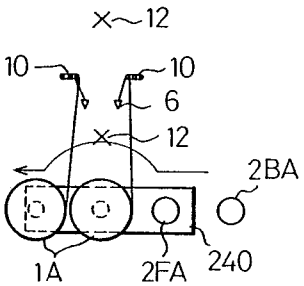
Figure 19F:
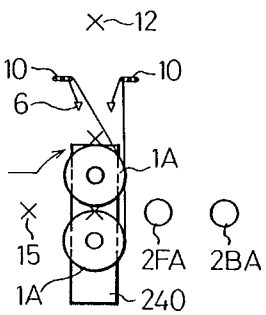
Figure 19G:
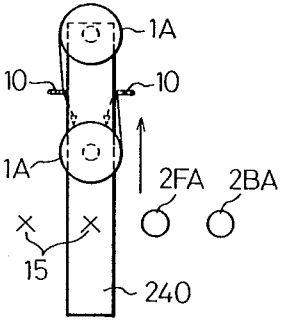
Figure 19H:
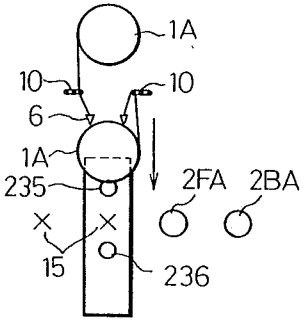

As mentioned above, when the working machine 30 is stopped at the working position in front of the spinning frame, the alignment between the peg units 235, 236 is the same as the alignment between the corresponding exhausted roving bobbins 2FB and 2FA facing each other in the creel of the spinning frame, respectively (FIG. 19A). In this condition, the forward displacement motion of the component elements of the peg unit is started, and after the peg units 235 and 236 arrive at the respective positions immediately below the corresponding half exhausted roving bobbins 2BA, 2FA, respectively, the peg unit 240 is displaced upwards up to the position at which these pegs can be inserted into the respective bottom apertures of the corresponding roving bobbins of the half exhausted roving bobbins 2BA, 2FA, and then downwards to catch these half exhausted roving bobbins 2BA, 2FA, by the corresponding pegs 235, 236 from the above-mentioned hangers of the creel. At this position of the peg unit 240, the motor M6, which rotates the respective pegs, is rotated in the winding direction to take up the excess rovings from these half exhausted roving bobbins 2FA and 2FB, which are suspended from the corresponding roving guides 10 (FIG. 19B), then, after the downward motion of the peg unit 240, the component elements of the peg unit 240 are displaced backwards to the respective positions which coincide to their standby positions (FIG. 19C). Then, after turning the peg unit 240 through 90°, the component elements thereof are displaced forward slightly so that these pegs 235 and 236 take the respective positions immediately below the corresponding empty bobbin hangers 15 of the supply rail, which take the adjacent positions (FIG. 19D). In this condition, since the engaging member 256 is not in contact with the stopper 257 during the above-mentioned forward motion of the component elements of the peg unit 240, because of the limited small displacement, the axial distance between two pegs, which is identical to the axial distance (a) between the above-mentioned two adjacent bobbin hangers 15, does not change. In the next step, the peg unit 240 is displaced upward so as to transfer the above-mentioned exhausted roving bobbins 2BA and 2FA to the above-mentioned respective adjacent empty bobbin hangers 15 on the supply rail 13, the component elements of the peg unit 240 are displaced slightly backward, the peg unit 240 is turned counterclockwise, and then the component elements of the peg unit 240 are displaced forward slightly so that the pegs 235 and 236 take the respective positions immediately below the corresponding full packaged bobbin hangers 1A, 1B suspended by the adjacent bobbin hangers 15 of the supply rail 13 (FIG. 19E) At this position, the peg unit 240 is displaced upwards, and after these full packaged roving bobbins 1A, 1B are received by the respective pegs 235 and 236, the motor 6 is rotated to create slack in the respective rovings from the full packaged roving bobbins 1A, 1B in the respective passages up to the corresponding roving guides 10, and the full packaged roving bobbins 1A, 1B are then separated from the respective bobbin hangers 15 by displacing the peg unit 240 downwards, while carrying these full packaged roving bobbins 1A 1B on the respective pegs 235,236 (FIG. 18E). In the next step, the component elements of the peg unit 240 are displaced backwards slightly, then the peg unit 240 is turned clockwise through 90° so that the peg unit 240 is returned to its standby position (FIG. 19F). In the next step, the component elements of the peg unit 240 are displaced forward so that the axial distance between two pegs 235 and 236 becomes identical to the axial distance of the front bobbin hanger 12 and the back bobbin hanger 12, facing each other in the creel. In this condition, the peg unit 240 is displaced upward to a position where the full packaged bobbins 1A, 1B mounted on the respective pegs 235, 236 come to the respective positions immediately below the above-mentioned front bobbin hanger 12 and the back bobbin hanger 12 from which the exhausted bobbin hangers 2BA and 2FA are taken off, respectively, and then the peg unit 240 is displaced upward so as to transfer the full packaged roving bobbins 1A, 1B from the respective pegs 235, 236 to the corresponding front and back bobbin hangers 12 of the creel facing each other (FIG. 19G). Since the full packaged roving bobbins 1A, 1A are transferred from the respective bobbin hangers 15 of the supply rail 13 to the corresponding front and back bobbins hangers 12 with slack in each roving from the full packaged roving bobbin as already explained, a possible breakage of the rovings during the above-mentioned steps for exchanging the roving bobbins can be effectively prevented. After the roving bobbin exchanging operation by the above-mentioned steps, the component elements of the peg unit 240 are displaced backward to their standby position (FIG. 19H). In this condition, the roving from the full packaged roving bobbin suspended by a back bobbin hanger and the roving from the full packaged roving bobbin suspended by a front bobbin hanger are guided by the respective roving guides 10 in the manner explained already.

The above-mentioned unit operations by the roving piecing apparatus 100 provided with the roving introducing device 180, and the roving bobbin exchanging apparatus 200 of the working machine 30 is completed, and this unit operation is stepwisely carried out in parallel and at the same time, from the first pair of a front exhausted roving bobbin and a back exhausted roving bobbin, facing each other, to the last pair of a front exhausted roving bobbin and a back exhausted roving bobbin, facing each other in the creel of the spinning frame.

In the above-mentioned embodiment, the roving introducing device 180 is mounted on the roving piecing apparatus 100, wherein the lifting device for displacing the full packaged roving bobbin supporting head 40 is utilized for the above-mentioned device 180 together with the apparatus 100. It is also practical to mount the roving introducing device 180 on the roving bobbin exchanging apparatus 200, wherein the device 180 is provided with a separate device for lifting the device 180. In this case, after mounting the full packaged roving bobbins 1A, 1B on the respective pegs of the roving bobbin exchanging apparatus 200 (similar to the condition shown in FIG. 19E), the operation by the roving introducing device 180 is carried out, and after the rovings are introduced to the respective roving guides 10, the full packaged roving bobbins 1A, 1B are suspended by the corresponding empty bobbin hangers 12, facing each other, in the creel. Such a modified method is also practical. On the other hand, instead of mounting the above-mentioned apparatus 100 and the apparatus 200 in a single working machine, they can be separated and operated as independent working machines which are capable of displacing along a spinning frame stepwisely, but in parallel and at the same time.

According to the introduction of the present invention to the spinning industry, the full automatic operation of the spinning process realizes a very effective reduction of labor cost in practice. The working efficiency of the spinning machine can be greatly improved, because the troublesome operation for exchanging roving bobbins at the time when the roving bobbins on the creel of the spinning frame become exhausted, can be carried out by the above-mentioned automatic machine without stopping the spinning operation. Another merit of the present invention is that the unit roving piecing operation and the unit roving bobbin exchanging operation are can be carried out separately, but in parallel and at the same time, even if these unit operations are applied to different pairs of front and back exhausted roving bobbins, facing each other, in the creel, and consequently, the time needed, to carry out the above-mentioned roving bobbin exchanging operation together with the roving piecing operation can be remarkably reduced, and consequently, the capacity of the working machines 30 is remarkably enhanced. In other words, the cost for the installation of an automatic machine such as the working machine 30 in the spinning mill can be remarkably reduced. It must be further recognized that, in the present invention, all pairs of front and back exhausted roving bobbins on the creel of the spinning frame are exchanged for the full packaged roving bobbins on the supply rail during the spinning operation, and thus it is not necessary to use a special machine for taking off the exhausted roving bobbins and for supplying full packaged roving bobbins carried by this special machine to the empty front and back bobbin hangers of the creel from which the exhausted roving bobbins have been taken off. Since, the present invention can be applied to the conventional ring spinning frames only by mounting a guide rail for guiding the working machine 30 along the spindle rail, and by mounting the supply rail in the condition as already explained, it is clear that the present invention can be of great practical value in forwarding the progress of the spinning industry.

We claim:

1. A method for piecing rovings introduced from almost exhausted roving bobbins suspended by two rows of bobbin hangers mounted on a creel of a conventional ring spinning frame with rovings introduced from full packaged roving bobbins suspended by bobbin hangers of a supply rail arranged in front of said creel, and for exchanging said almost exhausted roving bobbins for said full packaged roving bobbins, comprising the following operations:

piecing rovings whereby when roving bobbins of said creel become almost exhausted, each end of rovings of two adjacent full packaged roving bobbins of said supply rail are simultaneously caught, said caught roving ends being pieced with a corresponding one of rovings introduced from two adjacent almost exhausted roving bobbins suspended by said front row bobbin hanger and said back row bobbin hanger, from which rovings are supplied to two adjacent draft parts, and separating rovings from said almost exhaust®d roving bobbins supplied to said draft parts, and exchanging roving bobbins whereby after transferring said almost exhausted roving bobbins, suspended by said front bobbin hanger and said back bobbin hanger and having completed said roving piecing operation, to corresponding bobbin hangers of said supply rail simultaneously, said full packaged roving bobbins, having completed said roving piecing operation and supplying rovings to corresponding draft parts, are simultaneously transferred to corresponding bobbin hangers of the front row and back row from which said almost exhausted roving bobbins were taken off, wherein said roving bobbin exchanging operation and said roving piecing operation are performed in parallel and at the same time, and said roving bobbin exchanging operation and said roving piecing operation are performed from one side to another side of said ring spinning frame, along a longitudinal direction thereof.

2. The method as defined in claim 1, further comprising the step of introducing a pair o rovings from said full packaged roving bobbins supplying rovings to two corresponding adjacent draft parts into corresponding roving guides at respective positions upstream of said draft parts, after completion of said roving piecing operation.

3. The method as defined in claim 1, further comprising the step of introducing a pair of rovings from said full packaged roving bobbins supplying rovings to two corresponding adjacent draft parts into corresponding roving guides at respective positions upstream of said draft parts, immediately before performing said roving bobbin exchanging operation.

4. The method as defined in claim 1, wherein said roving piecing operation and said roving bobbin exchanging operation are applied to two adjacent pairs of exhausted roving bobbins suspended by the respective front bobbin hangers and the respective back bobbin hangers simultaneously, as a combined operation.

5. The method as define in claim 1, wherein said roving piecing operation is performed by turning each of said full packaged roving bobbins in an unwinding direction to firmly catch said end of said roving of each of said full packaged roving bobbins, while suspended by the respective bobbin hanger of said supply rail.

6. An apparatus for piecing rovings introduced from almost exhausted roving bobbins suspended by two rows of bobbin hangers mounted on a creel of a conventional ring spinning frame with rovings introduced from full packaged roving bobbins suspended by bobbin hangers of a supply rail arranged in front of said creel, and for exchanging said almost exhausted roving bobbins for said full packaged roving bobbins, comprising:

first means for piecing rovings introduced from two of said almost exhausted roving bobbins suspended by a front bobbin hanger and a back bobbin hanger, facing each other, with rovings introduced from two adjacent full packaged roving bobbins of said supply rail respectively, second means for exchanging said two almost exhausted roving bobbins and said two full packaged roving bobbins, having completed said roving piecing:

means for displacing said first and second means from one side to the other side along a spindle alignment of said spinning frame and means for actuating said first and second means, wherein said first means comprises means for catching ends of rovings from said full packaged roving bobbins suspended by two adjacent bobbin hangers of said supply rail, means for piecing said ends of rovings introduced from full packaged roving bobbins with corresponding rovings introduced from almost exhausted roving bobbins supplying roving s to two adjacent draft parts, and means for separating said rovings introduced from said almost exhausted roving bobbins from being supplied to corresponding draft parts after piecing said ends of rovings introduced from said full packaged roving bobbins with said rovings introduced from said almost exhausted roving bobbins.

7. The apparatus as defined in claim 6, wherein said second means comprises means for transferring a pair of almost exhausted roving bobbins suspended by said front bobbin hanger and said back bobbin hanger to said bobbin hangers without holding roving bobbins of said supply rail, after completion of a roving piecing operation simultaneously, and means for transferring a pair of full packaged roving bobbins suspended by said two adjacent bobbin hangers of said supply rail to a corresponding one of said front bobbin hanger and said back bobbin hanger of said creel of said spinning frame, from which said almost exhausted roving bobbins were taken off simultaneously, while supplying rovings to corresponding draft parts.

8. The apparatus as defined in claim 6, further comprising means for introducing rovings from said full packaged roving bobbins supplying respective rovings to corresponding draft parts, to respective roving guides facing said draft parts, after completion of a piecing rovings operation by said first means.

9. The apparatus as defined in claim 6, wherein:

said means for catching roving ends comprises a head for supporting a pair of full packaged roving bobbins, a pair of pegs rotatably mounted on said supporting head for supporting full packaged roving bobbins, and a catching device for catching each end of rovings from said full packaged roving bobbins mounted on said pegs by approaching thereto while said pegs are rotating, said means for piecing said ends of rovings comprises means for gripping a roving end held by said catching device, means for introducing said gripping means to the respective positions for piecing rovings on the supplying passage of said rovings from two almost exhausted roving bobbins supplying rovings to two adjacent draft parts, and means for releasing a gripping of said roving ends by said gripping means at said position for carrying out said roving piecing operation, and said means for separating said rovings comprises a mechanism for gripping said pair of rovings introduced from the respective almost exhausted roving bobbins suspended by said bobbin hangers of said creel of said spinning frame when said roving piecing operation is completed.

10. The apparatus as defined in claim 6, wherein said second means comprises a peg unit having a pair of pegs, a sliding mechanism for mounting said pegs in a condition allowing change of an axial distance therebetween, a telescopic mechanism for actuating said sliding mechanism, a mechanism for actuating said telescopic mechanism, a mechanism for lifting said peg unit, a mechanism for displacing said peg unit from a position where the alignment of pegs of said peg unit coincides with the alignment of a front bobbin hanger and a back bobbin hanger facing each other in said creel to a position where the alignment of pegs of said peg unit coincides with two corresponding adjacent bobbin hangers of said creel, whereby said axial distance between said two pegs can be changed between a first distance identical to a distance "a" between two adjacent bobbin hangers of said supply rail and a second distance identical to a distance "b" between a front bobbin hanger and a back bobbin hanger facing each other in said creel by actuating said mechanism for actuating said telescopic mechanism so that said sliding mechanism is actuated by the action of said telescopic mechanism, while said pair of pegs mounted on said sliding mechanism are positioned immediately below corresponding bobbin hangers by actuating said two actuating mechanisms together with said displacing mechanism.

11. The apparatus as defined in claim 6, wherein said means for introducing rovings to respective roving guides is mounted on said first means.

* * * * *